US006575446B2

(12) United States Patent
Wakabayashi et al.

(10) Patent No.: US 6,575,446 B2
(45) **Date of Patent: *Jun. 10, 2003**

(54) IMAGE FORMING APPARATUS HAVING SHEET FINISHER

(75) Inventors: Hiroyuki Wakabayashi, Hachioji (JP); Masato Hattori, Hachioji (JP); Teruhiko Toyoizumi, Hachioji (JP); Masaru Ohtsuka, Hachioji (JP); Tetsuhiro Kodera, Hachioji (JP); Kohji Yoshie, Hachioji (JP)

(73) Assignee: Konica Corporation (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 110 days.

(21) Appl. No.: 09/411,915

(22) Filed: Oct. 4, 1999

(65) Prior Publication Data

US 2002/0060388 A1 May 23, 2002

(30) Foreign Application Priority Data

| | | |
|---|---|---|
| Oct. 6, 1998 | (JP) | 10-284077 |
| Oct. 14, 1998 | (JP) | 10-292125 |
| Oct. 21, 1998 | (JP) | 10-299720 |
| Dec. 21, 1998 | (JP) | 10-362796 |

(51) Int. Cl.[7] ..... B65H 33/04

(52) U.S. Cl. ..... 270/58.07; 270/37; 270/58.11; 270/58.12

(58) Field of Search ..... 270/58.6, 58.11, 270/58.12, 58.07, 37, 18

(56) References Cited

U.S. PATENT DOCUMENTS

| | | | | |
|---|---|---|---|---|
| 4,989,852 | A | * 2/1991 | Gunther, Jr. | 270/56 |
| 5,259,605 | A | * 11/1993 | Yoshie et al. | 270/58.08 |
| 5,263,698 | A | * 11/1993 | Higuchi et al. | 270/58.05 |
| 5,382,011 | A | * 1/1995 | Tani | 270/37 |
| 5,433,249 | A | * 7/1995 | Tsubota et al. | 137/625.68 |
| 5,449,157 | A | * 9/1995 | Kawano et al. | 270/58.11 |
| 5,580,039 | A | * 12/1996 | Takehara et al. | 270/58.11 |
| 5,599,008 | A | * 2/1997 | Yamashita et al. | 270/58.16 |
| 5,639,078 | A | * 6/1997 | Mandel et al. | 270/58.12 |
| 5,642,876 | A | * 7/1997 | Ferrara et al. | 270/58.01 |
| 5,724,641 | A | * 3/1998 | Shojo et al. | 399/410 |
| 5,741,009 | A | * 4/1998 | Kawano et al. | 271/182 |
| 5,797,596 | A | * 8/1998 | Morigami et al. | 270/58.11 |
| 5,826,158 | A | * 10/1998 | Hirano et al. | 399/410 |
| 5,909,871 | A | * 6/1999 | Takehara | 270/58.07 |
| 5,913,099 | A | * 6/1999 | Kamei et al. | 399/296 |
| 6,006,065 | A | * 12/1999 | Seki | 399/407 |
| 6,012,385 | A | * 1/2000 | Gibson | 270/58.12 |
| H1842 | H | * 3/2000 | Tontarski | 227/100 |
| 6,047,960 | A | * 4/2000 | Kawano et al. | 270/58.11 |
| 6,079,706 | A | * 6/2000 | Hashem | 270/58.08 |
| 6,082,725 | A | * 7/2000 | Shinno et al. | 270/58.14 |
| 6,241,234 | B1 | * 6/2001 | Saitoh et al. | 270/58.12 |
| 6,283,354 | B1 | * 9/2001 | Hirota et al. | 227/140 |

* cited by examiner

*Primary Examiner*—Donald P. Walsh
*Assistant Examiner*—Jeffrey A. Shapiro
(74) *Attorney, Agent, or Firm*—Muserlian, Lucas & Mercanti

(57) ABSTRACT

An apparatus for finishing sheets is provided with a sheet conveyor to convey a sheet in a predetermined sheet conveyance direction on a sheet conveyance path; and a stapling device to conduct an edge stapling processing to put staple pins into an edge portion of sheets and a center stapling processing to put staple pins at a central portion of sheets, the stapling device having a plurality of staplers arranged in a direction perpendicular to the sheet conveyance direction, each of the plurality of staplers constructed in a two-divided piece structure including a driving mechanism provided one side of the sheet conveyance passage so as to put the staple pins into the sheets and a receiving mechanism provided the other side of the sheet conveyance passage so as to clinch the staple pins, and at least one of the plurality of staplers movable in a direction perpendicular to the sheet conveyance direction.

29 Claims, 27 Drawing Sheets

FIG. 20 ( a )
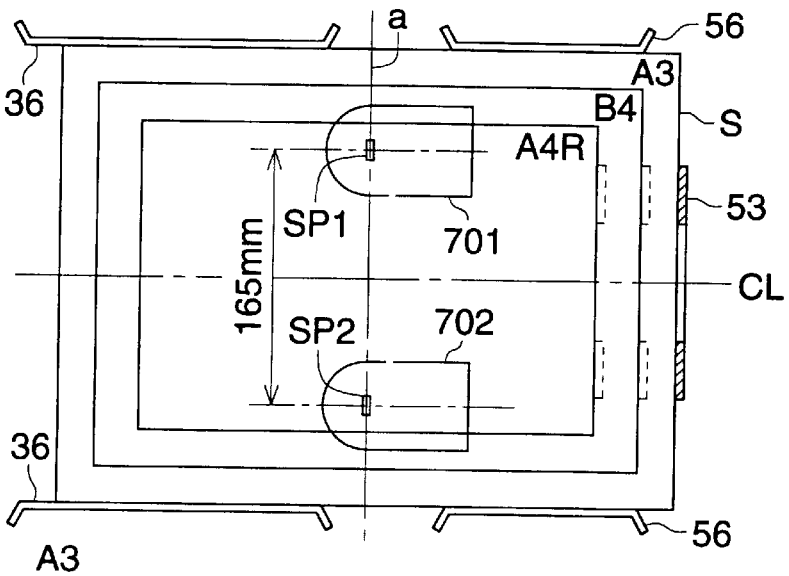
FIG. 20 ( b )
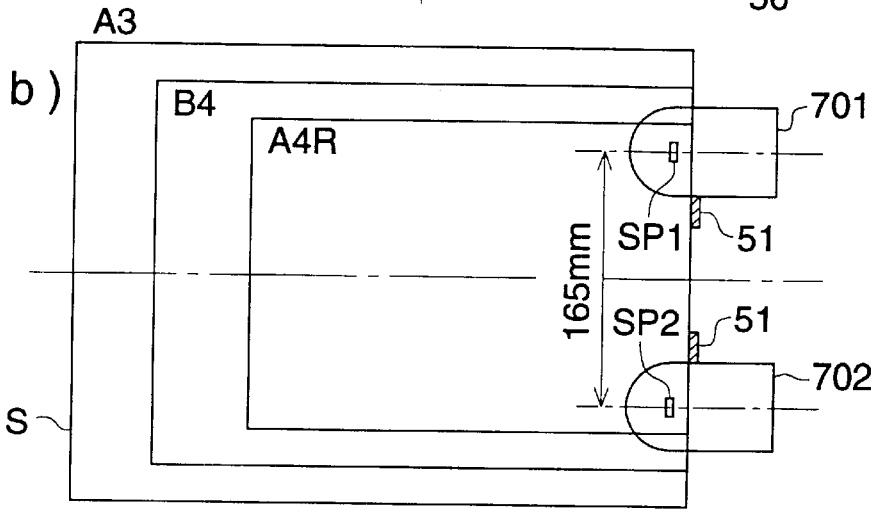
FIG. 20 ( c )
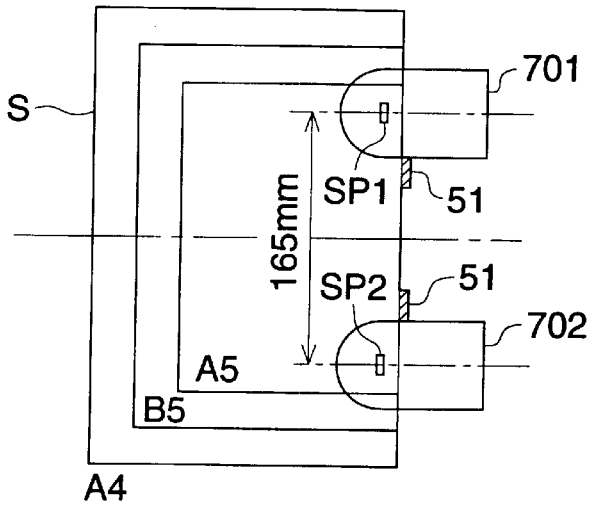

IMAGE FORMING APPARATUS HAVING SHEET FINISHER

BACKGROUND OF THE INVENTION

The present invention relates to a sheet finisher which conducts post processing such as stapling processing, folding processing, or similar processing on sheets on which images are recorded by an image forming apparatus such as a copier, printer, facsimile device, or hybrid machine including these apparatus, and to an image forming apparatus having the sheet finisher.

Conventionally, the following technology is well known as a sheet finisher which conducts edge stapling processing, or center stapling processing on a set of sheets which is formed such that a plurality of sheets on which images are recorded by an image forming apparatus such as a copier, or printer, are bundled to one set.

The technology disclosed in Japanese Tokkaisho No. 61-139495 is a sheet finisher in which a stapler for edge stapling and s stapler for center stapling are separately arranged.

The technology disclosed in Japanese Tokkaihei No. 2-144370 is a sheet finisher in which the following operations are conducted: when the center stapling processing is conducted, delivered sheet is switch-backed and conveyed to the center stapling position; and the trailing edge of the sheet is put in order on the reference surface and stacked, and then center stapling is conducted.

A sheet finisher which is composed of total 3 sets of staplers, that is, 2 sets of staplers for edge stapling processing for 2 portions in the vicinity of the sheet side edge and for center stapling processing for 2 portions in the central portion of the sheet, and further a slant stapling only stapler for slant edge stapling processing for one portion in the vicinity of the corner portion of the sheet, is conventionally known.

The following problems exist in the conventional technology.

(a) Because the edge stapling stapler and center stapling stapler are separately provided, the size of the overall sheet finisher is increased. Further, the production cost is increased.

(b) The distance to convey the sheet to the central stapling position is increased, and therefore, at the time of center stapling processing, a time period for the sheet arrangement is longer, thereby, the productivity for the sheet processing is lowered.

(c) Because 2 sets of staplers for the edge stapling processing and for the center stapling processing, and further a slant stapling only stapler for slant edge stapling processing are provided, and in order to prevent the interference between the slant stapling only stapler and the other 2 sets of staplers, the stapler driving mechanism becomes complicated. Further, total 3 sets of staplers are necessary, resulting in high production cost.

Further, a finisher as the sheet finisher is already disclosed in Japanese Tokkaisho No. 60-142359, No. 60-185463, No. 62-239169, further, Japanese Tokkaisho No. 62-288002, No. 63-267667, Japanese Tokkaihei No. 2-276691, No. 8-319054, and Japanese Tokkohei No. 5-41991.

A bookbinding apparatus disclosed in Japanese Tokkaisho No. 60-183459 has a cover sheet supply apparatus, and after a group of copying sheets and a cover sheet are superimposed, a bookbinding finishing operation such as holing or stapling is conducted.

Japanese Tokkaihei No. 6-72064, No. 7-187479, and No. 8-192951 disclose a sheet finisher having a center stapling processing function.

The above-described finisher has the following problems.

(d) In a sheet finisher which can conduct both of edge stapling processing to staple a set of sheets by putting stapler pins into one or two portions in the vicinity of the side edge of the set of sheets, and center stapling processing to staple a set of sheets by putting stapler pins into a central portion in the conveyance direction of a set of sheets, the edge stapling processed set of sheets is delivered by a normally rotating delivery belt and a delivery roller pair which is normally rotated by being interlocked with the delivery belt, onto a movable delivery sheet tray provided outside the apparatus.

In the case where sheets on which edge stapling processing is not conducted, exist on the movable delivery sheet tray, when the delivery belt and the delivery roller pair are reversely rotated in order to convey a set of sheets which is center stapling-processed, to the next twice-folding process, the trailing edge of the sheet on the movable delivery sheet tray is wound into the apparatus by the reversely rotating delivery roller pair and reversely moved into the apparatus, thereby, a sheet damage is generated.

(e) In the sheet finisher which can conduct both of the edge Stapling processing and center stapling processing, the delivery means to deliver the set of sheets which is edge stapling-processed, onto the movable delivery sheet tray outside the apparatus is different from a conveyance means to convey the set of sheets which is center stapling-processed, to the next process, therefore, the apparatus is complicated. Further, the timing adjustment for each of the delivery means after the edge stapling processing and the conveyance means after the center stapling processing is also complicated.

(f) In the conventional sheet finisher, a drive source (motor, etc.) of a movable stopper member for a flat stapling mode and a drive source (motor, etc.) of a movable stopper member for the center stapling are separately provided, thereby, the production cost is increased.

(g) When a stepping motor is used for a drive source, because sometimes a phase shift is generated by the external force, it is necessary that an initializing operation is conducted before the start of the drive, to position the motor at a position at which the drive can be started. When one portion is operated being interlocked with another portion, it is necessary to limit the order of each initializing operation. When the order of them is mistaken, interference is generated among operation members, resulting in a failure of the apparatus. In order to prevent that, the driving system of the apparatus becomes complicated, which is a defect.

(h) The length of the sheet in its conveyance direction is different depending on the environmental temperature, cutting accuracy, one side or two-sided recording, etc. After the leading edge portions of the sheets having the difference in the length are defined as the reference, and sheets are arranged at the leading edge portion, when center stapling and center-folding are conducted, the trailing edge portions of the sheets are irregular due to the difference of the length of the sheet. In the case where irregular trailing edge portions of this twice-folded processed set of sheets are cut by a cutter, or the like, when sheets are cut by making the edge portion of the outermost sheet as the reference, if the a sheet whose overall length is short, exists inside the set of sheets, an irregular portion remains after cutting, thereby, the finished appearance of the set of sheets is spoiled.

(i) In the case where a movable stopper member for the twice-folding is moved corresponding to the sheet size, stopped at a predetermined position, and the leading edge portion of the conveying set of sheets is positioned, when a stepping motor is used as a drive source, the movable stopper member is moved by the impulsive force from the leading edge portion of the conveying set of sheets. When the movable stopper member is moved and shifted from the predetermined position, the twice-folding portion at the center of the sheet is shifted, and the leading edge portion of the set of the sheets does not coincide with the trailing edge of the set of sheets, thereby, the finished appearance of the set of sheets is spoiled.

(j) In the conventional sheet finisher, a width arrangement means to arrange the sheet width direction perpendicular to the sheet conveyance direction is arranged on only the upstream side of the staple means in the sheet conveyance direction. When the edge stapling processing is conducted, the width arrangement means is located in the vicinity of the upstream side of the staple means, therefore, there is no problem. When the center stapling processing is conducted, the leading edge portion of the set of sheets is positioned by a positioning stopper which is arranged on far downstream side from the width arrangement means. In the vicinity of the positioning stopper, there is no limitation in the sheet width direction, therefore, the width direction of the sheet is not arranged in order. When the center stapling processing or center folding processing is conducted on this irregular set of sheets, the quality of external appearance of a finished booklet is decreased.

(k) A positioning means to arrange the leading edge portion in the sheet conveyance direction (sheet size stopper) is formed relatively small in the size, however, the width arrangement means to regulate the sheet width in the perpendicular direction to the sheet conveyance direction (side guide) is formed long in the sheet conveyance direction in order to prevent the slanting movement of the sheet, and the driving means is complicated, and a large area is necessary. When this width arrangement means is arranged on the upper side of the sheet conveyance surface, a gap above a sheet placement portion is small, and therefore, when a sheet conveyance failure (jam) is generated in the vicinity of the sheet placement portion, it is difficult to visually check the jammed sheet and take out it.

(l) In the conventional sheet finisher, the sheet placement board, staple means, sheet width arrangement means, and sheet leading edge portion positioning means to conduct the edge stapling processing and center stapling processing, are directly equipped in the sheet finisher main body. Accordingly, when a jam, failures-of component members, stapling failure, or the like, is generated in the sheet finisher, or when replenishment of stapler pins or the maintenance operation is conducted, it is necessary to conduct operations, adjustment, or the similar operations, in the sheet finisher, therefore, the working property is not good.

SUMMARY OF THE INVENTION

An object of the present invention is to provide a sheet finisher to solve the above-described problems (a)–(l) in the conventional sheet finisher, and to structure an upper and lower portion separation type stapler which conducts the edge stapling processing, center stapling processing, or slant end stapling processing on sheets delivered from an image forming apparatus, by a simple structure. Further object of the present invention is to provide a sheet finisher by which the phases of an upper mechanism driven portion and a lower mechanism driving portion of the upper and lower portion separation type stapler can be correctly maintained.

(1) A sheet finisher to solve the above-described problems is structured as follows. In a sheet finisher having a staple means for conducting edge stapling processing to put stapler pins into an edge portion of sheets, and center stapling processing to put stapler pins at a central portion of sheets, the stapling means is formed into a two-piece structure in which a driving side mechanism to put stapler pins into sheets is arranged on the lower side of a sheet conveyance path and a driven side mechanism to clinch stapler pins is arranged on the upper side of the sheet conveyance path; a plural sets of the two-piece structure staple means are arranged in the direction perpendicular to the sheet conveyance direction; the staple means can be moved in the direction perpendicular to the sheet conveyance direction by a driving means having only one driving source; at least one set of the staple means is driven so as to be rotated by a predetermined angle with respect to the direction perpendicular to the sheet conveyance direction; and the rotation center of the staple means almost coincides with the center of the stapler pin.

(2) In a sheet finisher having a conveyance means for successively receiving and conveying image-formed sheets conveyed from an image forming apparatus; a stacking means for positioning and stacking the received sheets; and a staple means for stapling the stacked sheets on the stacking means, the sheet finisher has: the staple means which can conduct both of edge stapling processing to staple one end of the sheet, and center stapling processing to staple the central portion of the sheets in the conveyance direction of the sheets, and which is two-piece structured so that the sheet can pass through the staple means; a movable stopper member for the center stapling processing which moves to a predetermined position in the conveyance direction of the sheets corresponding to the sheet size stacked on the stacking means and positions the sheet end; and a movable stopper for the edge stapling processing which is interlocked with the movement of the movable stopper member for the center stapling processing, and shuts off the sheet conveyance path, and positions the sheet ends so that the edge stapling processing can be conducted, and which is withdrawn from the sheet conveyance path so that the sheets to be center stapling processed can pass through the staple means.

(3) In the sheet finisher described in Item (2), the sheet finisher is structured as follows: when the movable stopper for the center stapling processing is positioned at a home position, the movable stopper member for the edge stapling processing is set at a sheet leading edge positioning position to shut off the sheet conveyance path; and when a power source of the sheet finisher is turned on, initialization of a stop position of the staple means is conducted after an initialization operation of the center stapling stopper unit.

(4) In the sheet finisher described in Item (2), the sheet finisher has a sheet positioning means for enabling a position of the movable stopper member for the center stapling processing to be adjusted corresponding to the length in the conveyance direction of the sheet conveying into the sheet finisher.

(5) In the sheet finisher described in Item (2), the sheet finisher has: the folding means for making the sheet twice-folded; a movable stopper member for folding means to move the sheet conveyed onto the stack board of the folding means to a predetermined position in the sheet conveyance direction corresponding to the sheet size, and to position the leading edge of the sheet; and a measurement means for measuring the length in the sheet conveyance direction of the sheet conveying into the sheet finisher, wherein the sheet positioning means of the movable stopper member for the center stapling processing and the sheet positioning means of the movable stopper member for the folding means determine the stop position on the basis of the minimum length in the sheet conveyance direction according to the measured value of the sheet length in the sheet conveyance direction by the measurement means, during the sheet post processing operation to produce one booklet.

(6) In the sheet finisher described in Item (5), the sheet finisher has: a stepping motor driving means for driving the movable stopper member to be movable; a control means for controlling the stepping motor driving means; and a detection means for detecting the entry of the sheet into the movable stopper member of the folding means, wherein the stepping motor driving means is controlled by the detection signal of the detecting means, and the rotation of the stepping motor driving means is stopped and fixed just before the leading edge portion of the sheet comes into contact with the movable stopper member.

(7) In the sheet finisher which can conduct both of the edge stapling processing to staple one end of sheets, and the center stapling processing to staple the central portion of the sheets in the conveyance direction, the sheet finisher has: a vertically movable sheet delivery tray which receives edge stapling processed sheets, or sheets which are not edge stapling processed; a sheet stacking portion on which sheets to be edge stapling processed and sheets to be center stapling processed are stacked; a delivery roller pair to nip the sheets and deliver them onto the movable delivery sheet tray; and a rotatable delivery means having a delivery member which comes into contact with the end portion of a set of sheets stacked on the sheet stacking portion, wherein, after the edge stapling processing, the delivery means is normally rotated and the delivery member presses the trailing edge portion of a set of processed sheets and conveys the set to the delivery roller pair, and the set of sheets are nipped by the roller pair and delivered onto the movable delivery tray; and after the center stapling processing, the delivery means is reversely rotated, and the delivery member presses the other end portion of the set of processed sheets and conveys the set to the next process, and before the reversal rotation of the delivery means, the movable delivery sheet tray on which delivered sheets are stacked, is lowered from a predetermined position.

(8) In the sheet finisher described in Item (7), the delivery member is switched to each of the standby position at the time of the edge stapling processing and the standby position at the time of the center stapling processing, and arranged at that position.

(9) In the sheet finisher which can conduct both of the edge stapling processing to staple one end of sheets, and the center stapling processing to staple the central portion of the sheets in the conveyance direction, and has a staple means which is divided-structured through the sheet path on which the sheet can pass at the time of the center stapling processing, an upper stream side width arrangement means and a downstream side width arrangement means for arranging the sheet width in the direction perpendicular to the sheet conveyance direction are arranged at each of the upper stream side and the down stream side in the sheet conveyance direction of the staple means.

(10) In the sheet finisher described in Item (9), a driving portion of a sheet end portion positioning means for regulating the sheet end portion in the sheet conveyance direction at the time of the edge stapling processing and the center stapling processing, is arranged on the upper side of the sheet conveyance surface, and a driving portion of the width arrangement means for regulating the sheet width in the direction perpendicular to the sheet conveyance direction, is arranged on the lower side of the sheet conveyance surface.

(11) In the sheet finisher described in Item (9), at least one set of staple means which is structured by being divided into upper and lower portions through the sheet path on which the sheet can pass at the time of the center stapling processing; the width arrangement means for arranging the sheets in the width direction perpendicular to the sheet conveyance direction; the sheet end portion positioning means to regulate the sheet end portion in the sheet conveyance direction; and the sheet stacking portion on which the sets of sheets to be subjected to the end stapling processing and center stapling processing are stacked, are structured into a unit, and the unit is structured so as to be drawn from the sheet finisher main body in the direction perpendicular to the sheet conveyance direction.

BRIEF DESCRIPTION OF THE DRAWINGS

FIGS. 20(*a*) to 20(*c*) each is a plan view showing the center stapling processing, and a plan view showing a two-portion edge stapling processing.

DETAILED DESCRIPTION OF THE PREFERRED EMBODIMENT

Next, referring to attached drawings, an embodiment of a sheet finisher of the present invention will be described.

Figure 1:
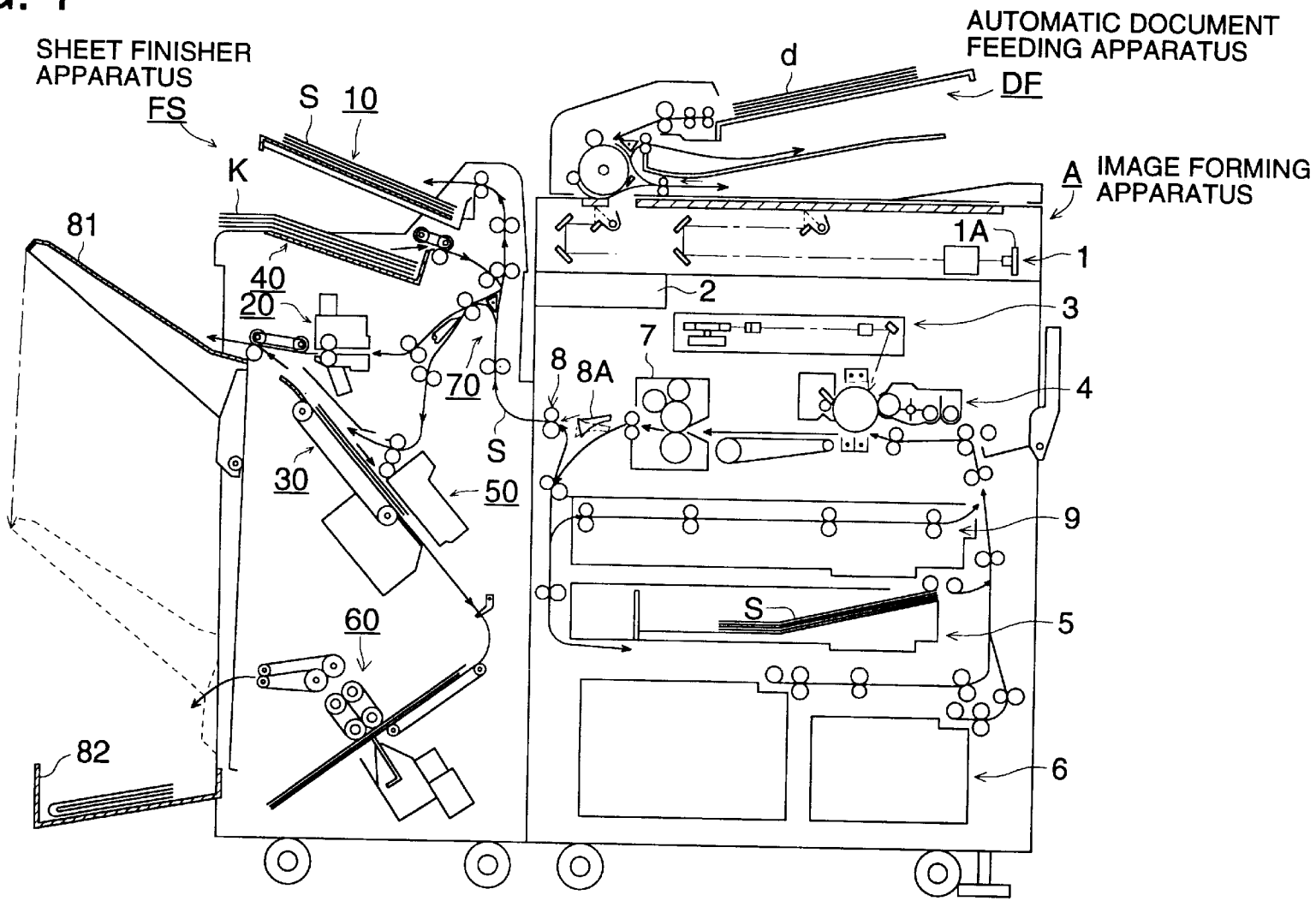
FIG. 1 is an overall structural view of an image forming apparatus provided with a sheet finisher and an automatic document feeding apparatus.

FIG. 1 is an overall structural view of an image forming apparatus provided with a sheet finisher FS and an automatic document feeder DF.

The image forming apparatus A shown in the drawing has an image reading section 1, image processing section 2, image writing section 3, image forming section 4, cassette sheet feeding section 5, large capacity sheet feeding section (LCT) 6, fixing device 7, sheet delivery section 8, and automatic two-sided copy sheet feeding section (ADU) 9.

The automatic document feeder DF is mounted on the upper portion of the image forming apparatus A. The sheet finisher FS is connected to the sheet delivery section 8 side on the left side surface in the drawing of the image forming apparatus A.

A document d placed on a platen of the automatic document feeder DF is conveyed in the arrowed direction, an image on the one side or two sides of the document is read by an optical system of the image reading section (scanning exposure apparatus) 1, and is read in a CCD image sensor 1A.

An analog signal photo-electrically converted by the CCD image sensor 1A is analog processed, A/D converted, shading corrected, and image compression processed in the image processing section 2, and after that, a signal is sent to the image writing section 3.

In the image writing section 3, an output light beam from a semiconductor laser is irradiated onto a photoreceptor drum in the image forming section 4, and a latent image is formed. In the image forming section 4, charge, exposure, development, transfer, separation, and cleaning processing are conducted, and the image is transferred onto a recording sheet (recording paper) S conveyed from the cassette sheet feed section 5 or large capacity sheet feed section 6. The recording sheet S on which the image is carried, is fixed by the fixing device 7, and sent into the sheet finisher FS from the sheet delivery section 8. Alternatively, the recording sheet S whose one side has been image processed, which is sent into the automatic two-side copy sheet feeding section 9 by a conveyance path switching plate 8A, is two-side image processed in the image forming section 4 again, and after that, sent into the sheet finisher FS from the sheet delivery section 8.

In the sheet finisher FS, from the upper stage in the drawing, a fixed delivery sheet tray 10, cover sheet feeding means 40, shift processing conveyance section (large capacity delivery sheet conveyance section) 20, intermediate stacking means 30, staple means 50, folding means 60, are vertically arranged in the almost vertical direction.

An entry conveyance section 70 is arranged at the right upper portion in the drawing of the sheet finisher FS. Further, on the left side surface in the drawing of the sheet finisher FS, a movable delivery sheet tray 81 on which edge stapled and shift processed sheets are stacked, and a fixed delivery sheet tray 82 on which center stapled and folding processed sheets are stacked, are arranged.

Figure 2:
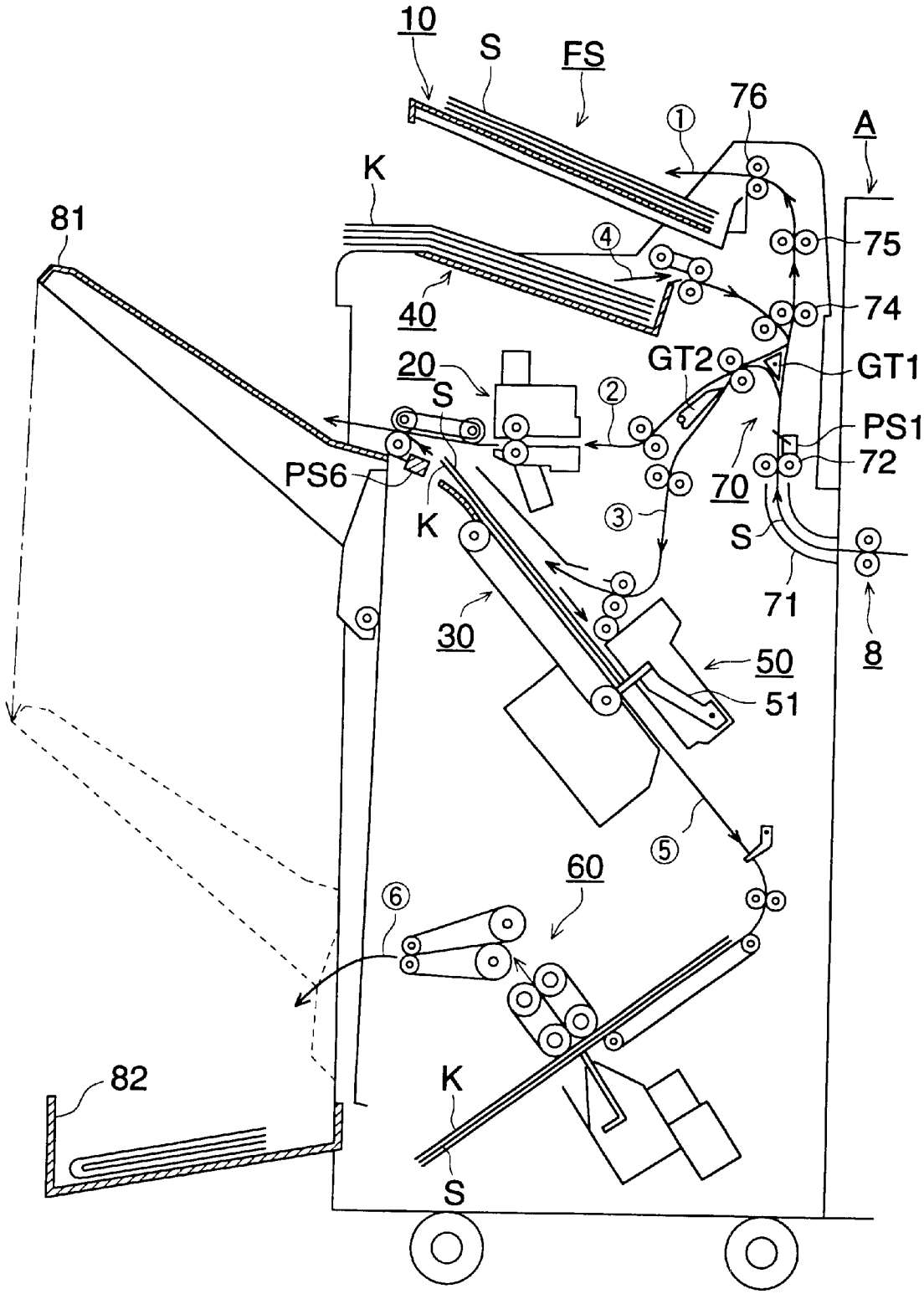
FIG. 2 is a typical view showing a sheet conveyance path of the sheet finisher.
Figure 3:
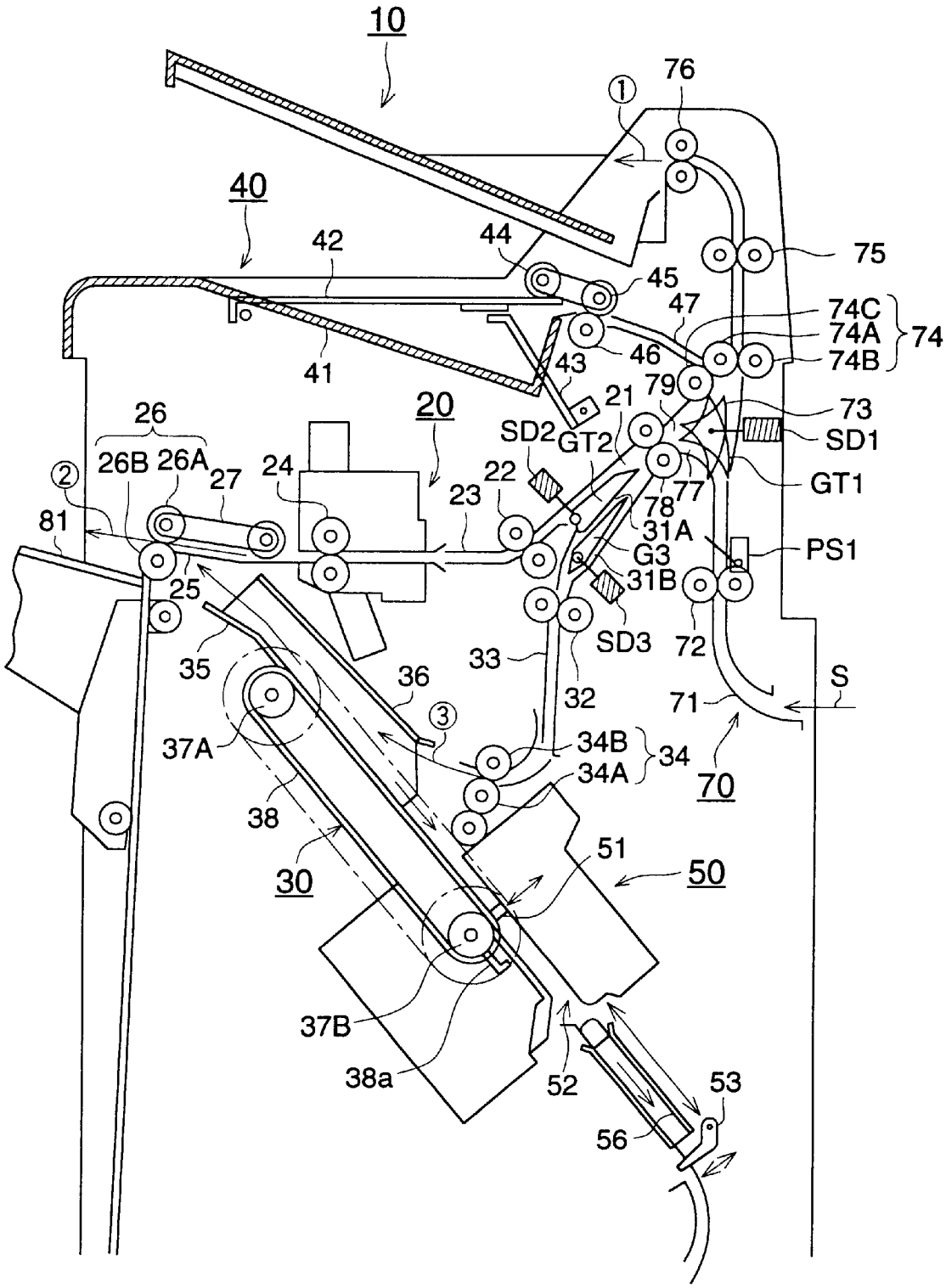
FIG. 3 is a sectional view showing an upper mechanism of the sheet finisher.

FIG. 2 is a typical view showing a sheet conveyance path of the sheet finisher FS, and FIG. 3 is a sectional view showing an upper mechanism of the sheet finisher FS.

The position and height of the sheet finisher FS is adjusted so that a receiving section 71 for the recording sheet S conveyed from the image forming apparatus A coincides with the sheet delivery section 8 of the image forming apparatus A, and then the sheet finisher FS is arranged.

The conveyance path of the recording sheet S connected to the downstream side of the sheet conveyance path of an entry section roller pair 72 of the receiving section 71 is branched into 3 routes of the first conveyance path (1) on the upper stage, the second conveyance path (2) on the intermediate stage, and the third conveyance path (3) on the lower stage, and by the selection of an angle taken by switching gates G1 and G2, the recording sheet S is sent to any one of the conveyance paths.

(1) The first conveyance path (1) (non-staple, non-sort mode, the sheet is delivered onto the fixed delivery sheet tray 10 on the upper portion of the apparatus)

The recording sheet S on which the image has been formed, and which is delivered from the image forming apparatus A, is introduced into the receiving section 71, conveyed by the entry section roller pair 72, passes through the path 73 provided on the right side of the first switching gate G1 in the upper portion, nipped by the upper conveyance roller pair 74 (a drive roller 74A and driven roller 4B), and conveyance roller pair 75 and conveyed upward, and further nipped by the delivery roller pair 76 and delivered onto the fixed delivery sheet tray 10 provided at the upper portion out side the apparatus, and stacked successively.

In this sheet conveyance process, the switching gate G1 is oscillated by the drive of a solenoid SD1, and blocks the path 77 and opens the path 73, thereby, the recording sheet S can pass to the fixed delivery sheet tray 10.

Maximum 200 recording sheets S can be accommodated on this fixed delivery sheet tray 10, and the fixed delivery sheet tray 10 can be easily taken out of the upper portion of the sheet finisher FS.

(2) The second conveyance path (2) (offset mode or non-sort mode, the sheet is delivered on the movable delivery sheet tray 81)

When the sheet finisher is set to this conveyance mode, the switching gate G1 blocks the path 73 and the path 77 is held to be opened, under the condition that the solenoid SD1 is off, therefore, the recording sheet S can pass through the path 77.

The recording sheet S on which the image has been formed, and which is delivered from the image forming apparatus A, passes through the receiving section 71, and the entry section roller pair 72, and passes through a path 77 formed to be an opened condition below the switching gate G1, held by a conveyance roller pair 78, passes through the path 21, which is the second conveyance path (2), provided at an upper portion of the second switching gate G2 located in the slanting lower portion, held by the conveyance roller pair 22, and through the path 23, held by the conveyance roller pair (shift roller pair) 24, and through the path 25, delivered and stacked on the movable delivery sheet tray 81 provided outside the apparatus, by the delivery roller pair 26 (upper roller 26A, lower roller 26B). Numeral 27 is an oscillation means for oscillating the upper roller 26A so as to pressure-contact with or separate from the lower roller 26B.

Maximum 3000 recording sheets S (A4, B5) can be accommodated on this movable delivery sheet tray 81.

(3) The third conveyance path (3) (edge stapling mode, the sheet is delivered on the movable delivery sheet tray 81)

The recording sheet S which is image forming processed in the image forming apparatus A, and is sent into the receiving section 71 of the sheet finisher FS, and on which an image has been formed, passes through the entry section roller pair 72 and the path 77 provided lower the first switching gate G1, and is nipped by the conveyance roller pair 78, and conveyed to the third conveyance path (3).

In the third conveyance path (3), when the recording sheet S whose size is larger than A4 or B5 sized sheet, is conveyed, a solenoid SD2 is driven, and the recording sheet S passes the path 31A provided lower the switching gate G2, and is nipped by the conveyance roller pair 32 located downstream and conveyed. The recording sheet S is nipped by the conveyance roller pair 34 (drive roller 34A, driven roller 34B) located further downstream, and sent out and delivered to the space above the slantingly arranged intermediate stacker 35, and comes into contact with the intermediate stacker 35 or the upper surface of the recording sheet S stacked on the intermediate stacker 35, and slides upward, and then, after the trailing edge of the recording sheet S in the advancing direction has been delivered from the conveyance roller pair 34, the recording sheet S is turned to move downward by the self weight, and slides downward on the slanting surface of the intermediate stacker 35, and the end portion of the recording sheet S contacts with the sheet contact surface of the movable stopper member for edge stapling (hereinafter, called edge stapling stopper) 51 in the vicinity of the staple means (stapling means) 50, and stops.

In the third conveyance path (3), in order to effectively continuously convey the small sized recording sheet S such as A4 or B5 sized sheet and increase the copy productivity, a path 31B parallel to the path 31A below the switching gate G2 and a switching gate G3 are provided.

When the solenoid SD2 for the switching gate G2, and the solenoid SD3 for the switching gate G3 are driven together, both of the leading edge portions of switching gates G2 and G3 are oscillated counterclockwise in the drawing, paths 21 and 31A are blocked, and the path 31B is opened. The leading edge portion of the first recording sheet S sent from the conveyance roller pair 78 passes through the path 31B, and contacts with the peripheral surface of the conveyance roller pair 34 whose rotation is stopped, and stops.

Next, the solenoid SD3 is turned off, the leading edge portion of the switching gate G3 is oscillated clockwise, the path 31B is blocked, and the path 31A is opened. The leading edge portion of the second recording sheet S sent from the conveyance roller pair 78 passes through the path 31A, and contacts with the peripheral surface of the conveyance roller pair 34 whose rotation is stopped, and stops.

The conveyance roller pair 34 is rotated with predetermined timing, and holds the two recording sheets S and conveys them at the same time, and delivers them onto the intermediate stacker 35. The third and subsequent sheets are delivered one by one sheet.

Numeral 36 is a pair of width arrangement means provided movably on both side surfaces of the intermediate stacker 35. The width arrangement means 36 can move in the direction perpendicular to the recording sheet conveyance direction, and at the time of the recording sheet reception when the recording sheet S is delivered onto the intermediate stacker 35, the width arrangement means is opened wider than the width of the recording sheet, and when the recording sheet S slides down on the intermediate stacker 35, and contacts with the edge stapling stopper 51 and stops, the width arrangement means taps the side edge in the width direction of the recording sheet S, and arranges the width of a set of the recording sheets (width arrangement). In this stop position, when a predetermined number of recording sheets S are stacked and arranged on the intermediate stacker 35, the stapling processing is conducted by the staple means 50, and a set of recording sheets is stapled.

A cutout portion is formed on one portion of the recording sheet stacking surface of the intermediate stacker 35, and a plurality of delivery belt 38 which are wound around a drive pulley 37A and a driven pulley 37B, are rotatably driven. A delivery claw 38*a* is integrally formed a portion of the delivery belt 38, and its leading edge portion draws an elliptical orbit as shown by one dotted chain line in the drawing. The staple processed set of sheets is placed on the delivery belt 38 while the trailing edge of the recording sheet S is held by the delivery claw 38*a* of the delivery belt 38, slides on the sheet placement surface of the intermediate stacker 35 and is pushed slantingly upward, and advances to the nip position of the delivery roller pair 26. The set of recording sheets held by the rotating delivery roller pair 26 is delivered and stacked on the movable delivery sheet tray 81.

(4) The fourth conveyance path (4) (cover sheet feeding mode)

A cover sheet feeding means 40 comprises a cover sheet placement section composed of a sheet feeding tray 41, movable base plate 42, and push-up lever 43, and a cover sheet sending means composed of a pick-up roller 44, feed roller 45, and handling roller 46, etc.

One cover sheet K fed from the cover sheet feeding means 40 passes through a path 47, passes a nip portion of a driving roller 74A and a driven roller 74C of the conveyance roller pair 74, and after passing through a path 79 and a conveyance roller pair 78, the cover sheet K reaches on the intermediate stacker 35 through the conveyance roller pair 32, path 33, and conveyance roller pair 34 of the third path (3).

The conveyance roller pair 74 is composed of a center drive roller 74A and 2 driven rollers 74B and 74C which pressure-contact with the drive roller 74A. When the drive roller 74A is rotated left as shown in the drawing, the driven roller 74B is rotated right and conveys the recording sheet S conveyed from the path 73 upward. Simultaneously, the driven roller 74C is also rotated right, and conveys the cover sheet K conveyed from the path 47 to the lower path 79. Accordingly, by the rotation of the drive roller 74A, the recording sheet S on the first path (1) and the cover sheet K on the fourth path (4) can be simultaneously conveyed in the reverse directions.

(5) The fifth conveyance path (5) (center stapling mode)

Figure 4:
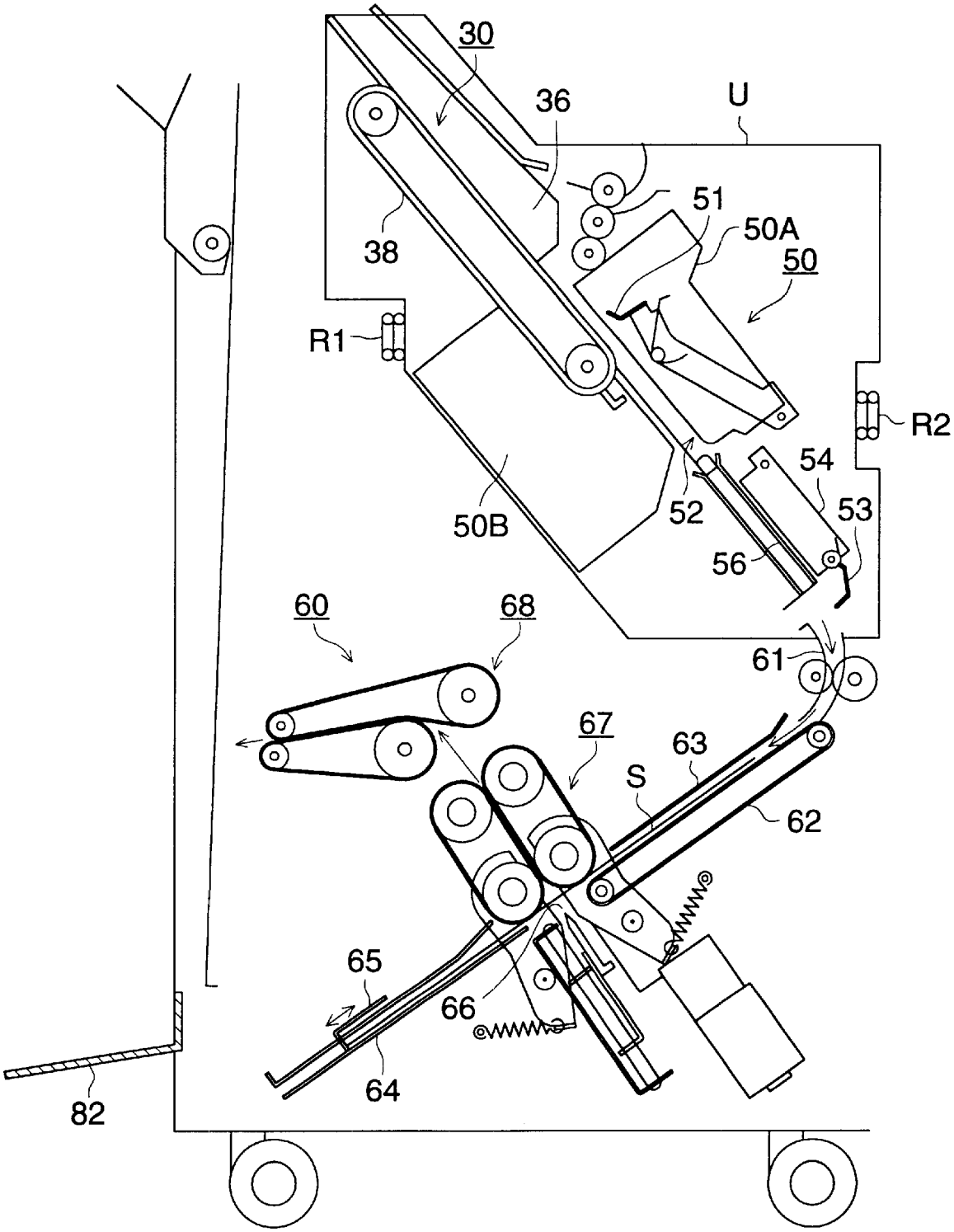
FIG. 4 is a sectional view showing a lower mechanism of the sheet finisher.

FIG. 4 is a sectional view showing the stapling processing section and twice-folding processing section of the sheet finisher FS.

The staple means SO and the edge stapling stopper 51, and the movable stopper member for the center stapling (hereinafter, called center stapling stopper) 53 are formed in a stapling section unit U, and the unit U is guided by guide rails R1 and R2, and can be pulled out in the front surface side of the sheet finisher FS.

The staple means 50 is structured into two-piece structure of the upper mechanism and the lower mechanism, and the path 52 through which the recording sheet S can pass, is formed between them.

When the center stapling mode is set, the edge stapling stopper 51 located in the vicinity of the stapling processing position of the staple means 50 is withdrawn from the conveyance path, and at the almost same time, the center stapling stopper 53 located at its downstream side is started and blocks the path 52.

When the size (the length in the conveyance direction) of the cover sheet K and the recording sheet S are set or detected, the center stapling stopper 53 is moved to a predetermined position and stops.

After the cover sheet K is placed at a predetermined position on the intermediate stacker 35, the recording sheet S conveyed from the image formation surface A passes through from the entry conveyance section 70 of the sheet finisher FS to the third conveyance path (3), and successively stacked on the upper surface of the cover sheet K placed on the intermediate stacker 35, and the end portion of the recording sheet S contacts with the center stapling stopper 53, and the recording sheet S is positioned. Numeral 56 is a width arrangement means on the downstream side to regulate the width direction of the recording sheet at the time of the center stapling processing, and in thee same manner as the width arrangement member 36 on the upstream side, every time when one recording sheet is conveyed, it taps the side end in the width direction of the recording sheet and conducts the width arrangement.

The upstream side width arrangement means 36 and the downstream side width arrangement means 56 selectively conduct width arrangement driving depending on the setting of the edge stapling processing or center stapling processing. That is, at the time of the edge stapling processing, only the width arrangement means 36 on the upstream side is driven, and the width arrangement means 56 on the downstream side is not driven. Accordingly, noise reduction and power saving can be attained.

At the time of center stapling processing, both of the upstream side width arrangement means 36 and the downstream side width arrangement means 56 are driven. At the time of center stapling processing, the downstream side width arrangement means 56 is driven later than the upstream side width arrangement means 36. Thereby, the overlapping of peak electric power at the time of starting of the driving system can be avoided.

Further, at the time of center stapling processing, with respect to the recording sheet S which slides down on the intermediate stacker 35 and advances on the upstream side of the staple means 50, initially, the width arrangement means 36 on the upstream side conducts width arrangement and arranges the sheet, next, with respect to the recording sheet S which passes through the staple means 50 and advances toward the center stapling stopper 53, the width arrangement is conducted by the downstream side width arrangement means 56, and the sheet is arranged. According to these operations, the recording sheets S and cover sheet K which advance on the intermediate stacker 35, and which are stacked on both sides of staple means 50 extending from the upstream side to the downstream side, are correctly width-arranged along the overall length of the sheet by the upstream side width arrangement means 36 and the downstream side width arrangement means 56.

After the final recording sheet S is positioned and placed on the intermediate stacker 35, the staple means 50 center stapling processes on the set of sheets composed of the cover sheet K and overall pages of recording sheets S. According to this center stapling processing, the stapler pins SP are put into the central portion in the conveyance direction of the cover sheet K and the recording sheet S. The stapler pin SP is put into the sheets from the lower mechanism 50B having the stapler pin putting-in drive side toward the upper mechanism 50A having the stapler pin clinch side.

(6) The sixth conveyance path (6) (twice-folding processing mode)

After center stapling processing, the center stapling stopper 53 is oscillated, the path downstream of the path 52 is opened. The set of sheets composed of center stapling processed cover sheet K and the recording sheets S passes the curved path 61, conveyed on the conveyance belt 62 provided at slant lower portion guided by the guide plate 63, and further, conveyed on the guide plate 64, and the end portion in the conveyance direction of the set of sheets comes into contact with a folding section movable stopper member (hereinafter, called folding section stopper) 65, and stops at a predetermined position. The folding section stopper 65 can be moved to a predetermined position by setting of the sheet size or detection result thereof, and driving means.

A protrusion unit 66 is arranged at the slant lower portion of the central portion in the conveyance direction of the set of sheets on the stopped condition, that is the center stapling position. A folding roller pair portion 67 and a twice-folded sheet conveyance means 68 are arranged at the slant upper portion of the center stapling portion.

Figure 5:
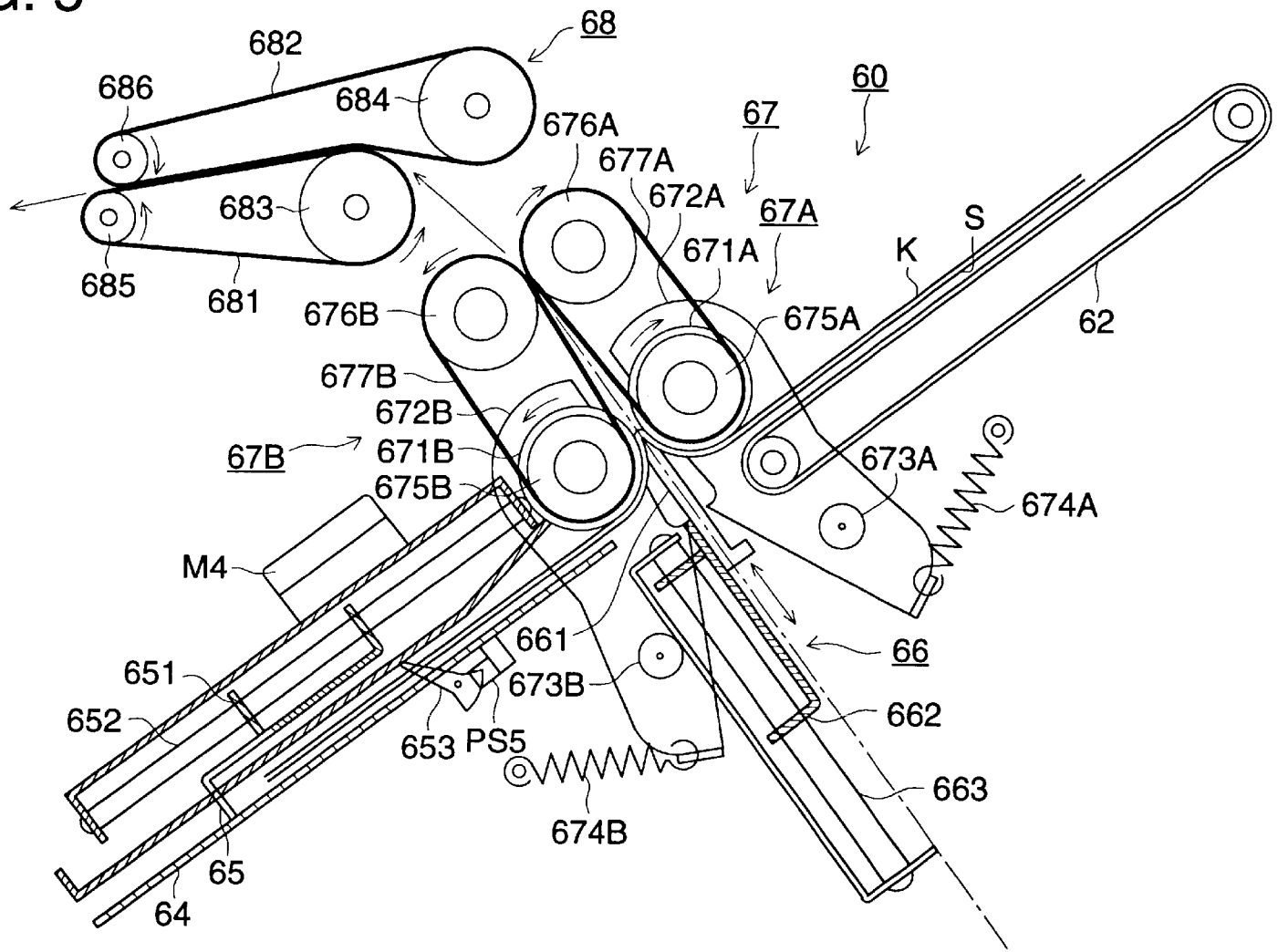
FIG. 5 is a sectional view of a protruding unit, folding roller pair portion, and twice-folded sheet conveyance means.

FIG. 5 is a sectional view of the folding means 60 composed of the protrusion unit 66, folding roller pair 67, and twice-folded sheet conveyance means 68.

By a twice-folding start signal, a movable holding member 662 goes straight on along a fixedly arranged guide bar 663, and a protrusion plate 661 fixed on the movable holding member 662 protrudes upward from the sheet placement surface. The protrusion plate 661 is formed into the shape of a thin knife, and its leading edge portion has an acute angle.

The leading edge portion of the protrusion plate 661 which goes straight on slantingly upward and protrudes, pushes up the central portion of the set of sheets composed of the cover sheet K and recording sheets S, and widens the nip portion of the folding roller pair portion 67 through the set of sheets, and oscillates and separates the nip portion of the folding roller pair portion 67 from each other.

After the leading edge portion of the protrusion plate 661 has passed the nip portion, the protrusion plate 661 is withdrawn, and the central portion of the set of sheets is pressed by the folding roller pair portion 67, and a fold is formed. This fold almost coincides with the put into position of the stapler pin onto the center stapling processed set of sheets.

A pressing means 67A of the folding roller pair portion 67A is composed of a front stage folding portion structured by: the first pressing roller 671A driven by being connected to the driving source; an arm 672 which rotatably supports the first pressing roller 671A, and can oscillate around the support shaft 673A; and a spring 674A which is engaged with one end of the arm 672A, and forces the first pressing roller 671A toward the nip position direction; and a back stage folding portion structured by: the second pressing roller 676A driven by being connected to the driving source; and a conveyance belt 677A wound around a pulley 675A which is coaxial with the first pressing roller 671A and the second pressing roller 676A.

The other pressing means 67B has the same structure, and has the first pressing roller 671B, arm 672B, support shaft 673B, spring 674B, pulley 675B, the second pressing roller 676B, and conveyance belt 677B. In this connection, the second pressing rollers 676A, and 676B are supported so that they can be oscillated, by an arm, support shaft and spring, which are the same as those of the first pressing rollers and not shown in the drawing.

The central portion of the set of sheets which are formed into folds by being pressed by the rotating first pressing rollers 671A and 671B, is held and conveyed by conveyance belts 677A and 677B, and sent into a nip portion of the second pressing rollers 676A and 676B, and at this position, the folds are further ensured, and the set of sheets is sent into a twice-folded sheet conveyance means 68.

The twice-folded sheet conveyance means 68 is structured by the lower conveyance belt 681 and upper conveyance belt 682, by which the set of sheets are pressed and conveyed. The lower conveyance belt 681 are trained around a drive roller 683 and driven roller 685, and can be rotated. The upper conveyance belt 682 are trained around a drive roller 684 and driven roller 686, and can be rotated.

The set of sheets sent into twice-folded sheet conveyance means 68 is held between the lower conveyance belt 681 and upper conveyance belt 682 and conveyed, and delivered onto the fixed delivery sheet tray 82 provided outside the apparatus.

Figure 6:
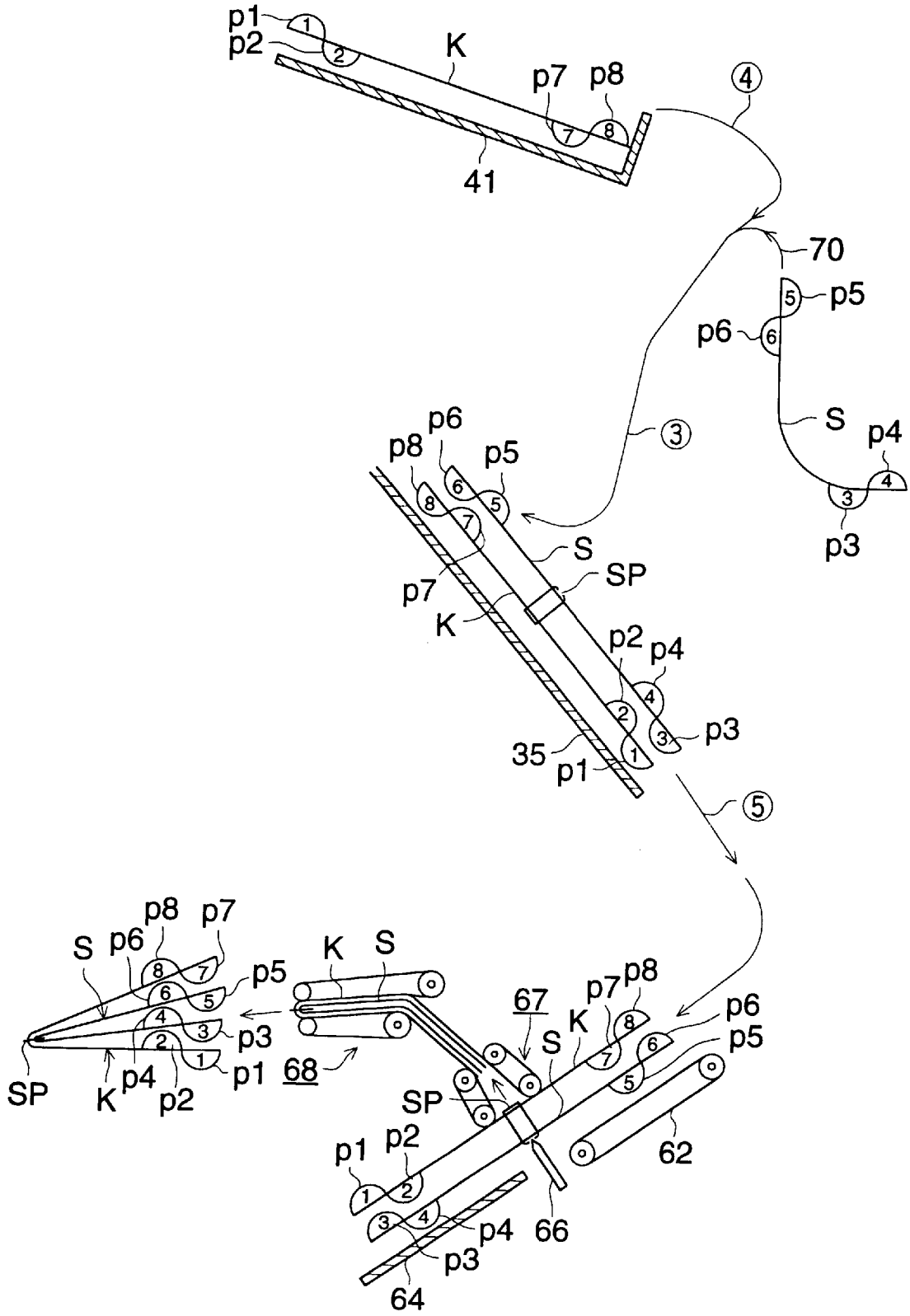
FIG. 6 is a typical view showing a conveyance path of a cover sheet and a recording sheet, and a process of center stapling processing and twice-folding processing of a set of sheets.
Figure 7:
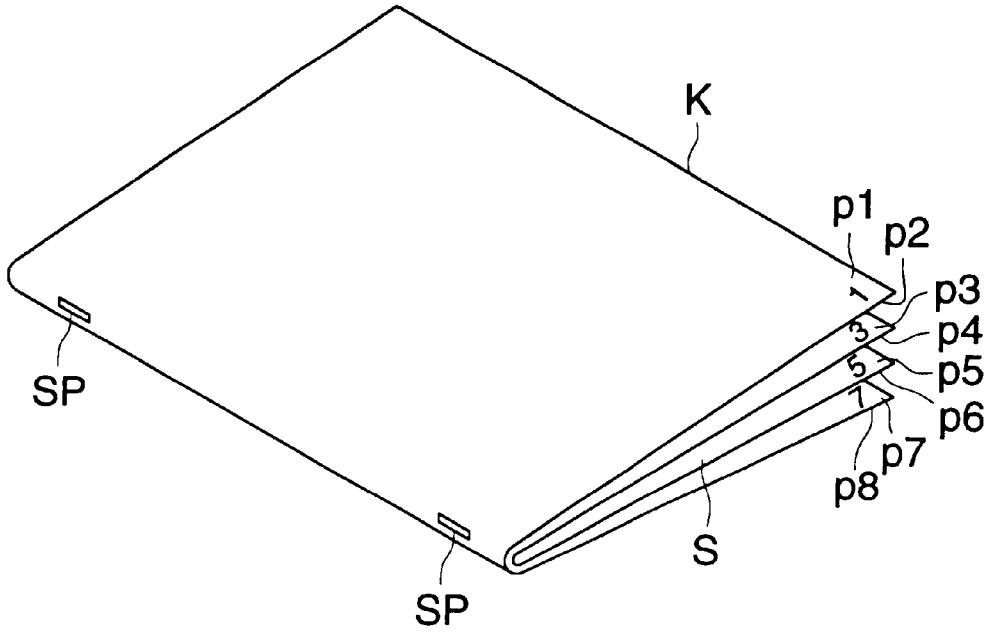
FIGS. 7(*a*) and 7(*b*) are perspective views of a booklet on which the center stapling processing and twice-folding processing are conducted, and a perspective view showing a condition that the booklet on which post processing is conducted, is opened with both pages.
Figure 7:
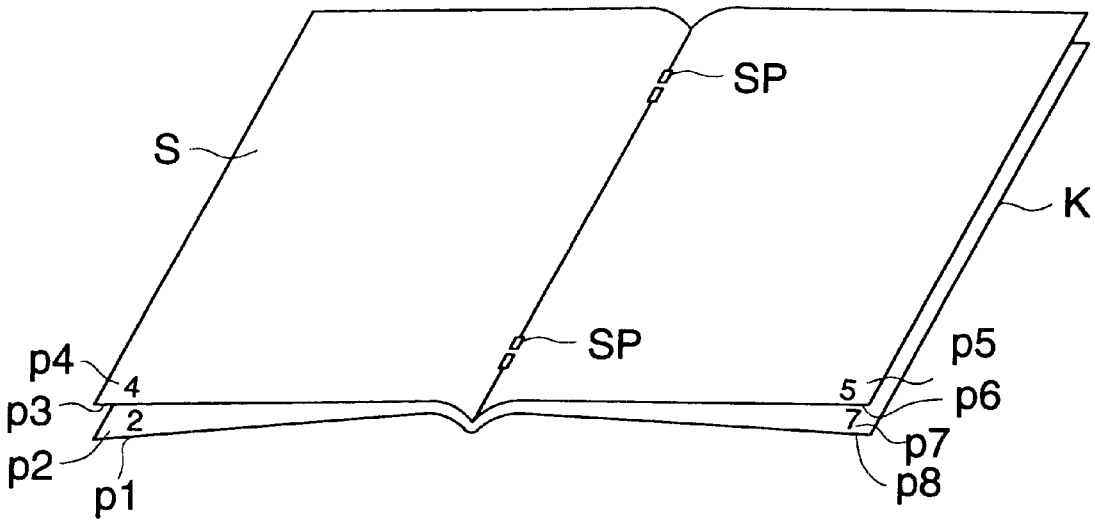

FIG. 6 is a typical view showing the conveyance path of the cover sheet K and the recording sheets S, and the center stapling and twice-folding process of the set of sheets. FIG. 7(*a*) is a perspective view showing a booklet on which post processing of the center stapling and twice-folding has been conducted, and FIG. 7(*b*) is a perspective view showing the condition that the post processed booklet is opened with two pages.

On the sheet feed tray 41 of the cover sheet feeding means 40, the cover sheet K is placed with its first side (the first page p1, the eighth page p8) facing upward. The cover sheet K fed from the sheet feed tray 41 by the sheet feeding means is conveyed through the fourth conveyance path (4) and the third conveyance path (3), and placed on the intermediate stacker 35 with its first side (p1, p8) facing downward.

Next, the recording sheet S which is conveyed from the image forming apparatus A and on which an image has been formed, is introduced into the sheet finisher FS with its the first side (the third page p3, the sixth page p6) facing downward. This recording sheet S is conveyed from the entry conveyance portion 70 to the third conveyance path (3), and placed on the cover sheet K placed on the intermediate stacker 35 with its first side facing downward.

On the intermediate stacker 35, the cover sheet K and the recording sheets S are arranged, and the stapler pin SP is put into them by the staple means 50, and the cover sheet K and the recording sheets S are center stapling processed.

The center stapling processed set of sheets passes through the fifth conveyance (5), and is placed at a predetermined position on the guide plate 64 and conveyance belt 62, and stops. At that time, the set of sheets is placed under the condition that first side (p3, p6) of the recording sheets S faces upward, and the first side (p3, p6) of the cover sheet K on the recording sheets S faces upward.

Next, twice-folding processing is conducted by a pushing-up operation of the protrusion unit 66 and the rotation of the folding roller pair portion 67, then, the set of sheets is held and conveyed, and delivered onto the fixed delivery sheet tray 82 by the twice-folding conveyance means 68.

In the booklet made by center stapling processing and twice-folding processing, the first side (p1, p2) of the cover sheet K faces outside, and the second side (p2, p7) is arranged on the rear side of the first side, and further, on its inner side, the first side (p3, p6) of the recording sheets S, which is the contents of the booklet, and on its inner side, the second side (p4, p5) of the recording sheets S are arranged, and, as shown in the drawing, the page arrangement of the booklet made of 8 pages (p1–p8) can be conducted in order.

Figure 8:
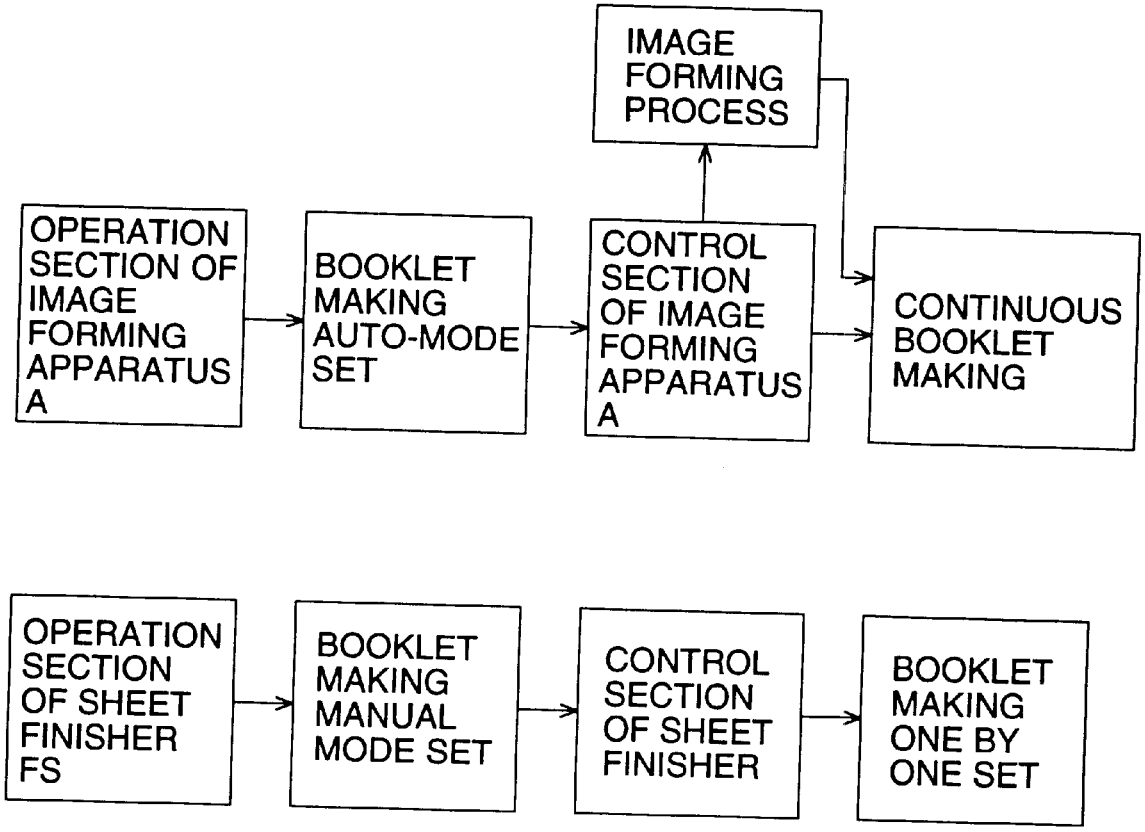
FIG. 8 is a block diagram showing the control of the sheet finisher.

FIG. 8 is a block diagram showing the control of the sheet finisher according to the present invention. In the operation section of the image forming apparatus A, when the booklet making auto-mode is selected and set, and the cover sheet K is placed on the sheet feeding tray 41, and printing is started, the image forming process is carried out by the control of the image forming apparatus A, and the recording sheet S by which an image is carried, is center stapling processed and twice-folding processed by the sheet finisher FS, and the booklet is continuously made and delivered.

In the operation section of the sheet finisher FS, when the booklet making manual mode is selected and set, and the cover sheet K and a set of image formed recording sheets S are stacked on the sheet feeding tray 41, and a feeding operation is started, then, by the control section of the sheet finisher FS, the cover sheet K and recording sheets S are center stapling processed and twice-folding processed by the sheet finisher FS, and one booklet is made and delivered.

Figure 9:
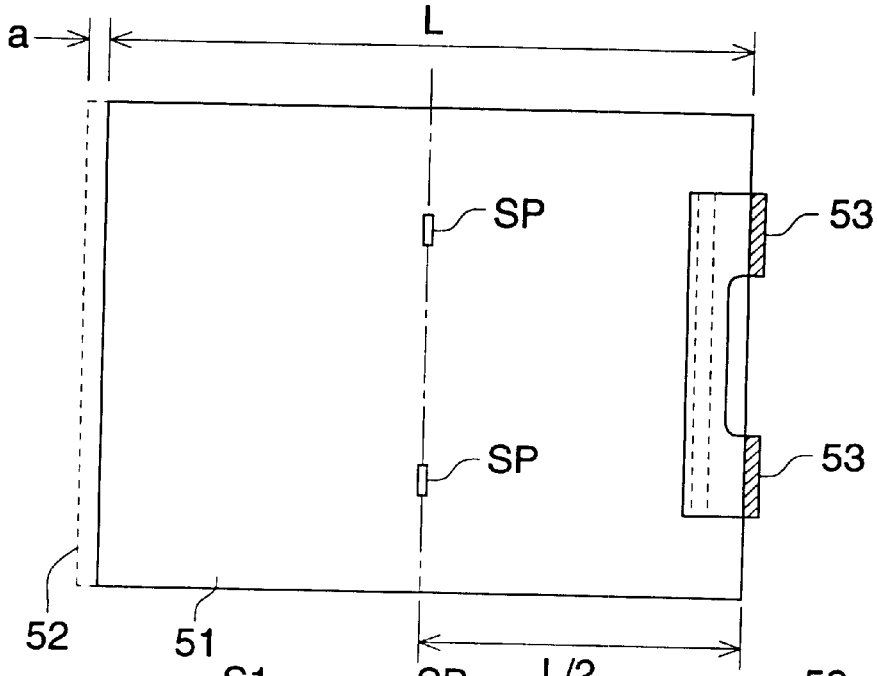
FIGS. 9(*a*) to 9(*d*) are typical views showing a process of the center stapling processing and folding processing.
Figure 9:
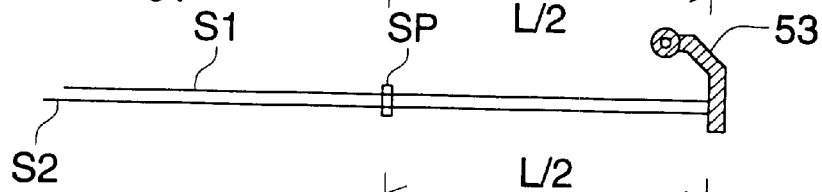
Figure 9:
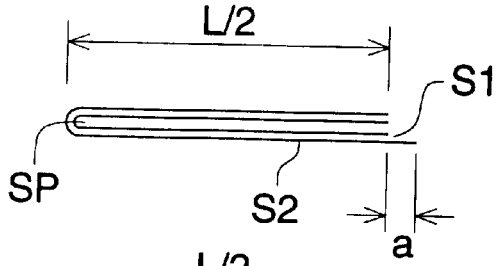
Figure 9:
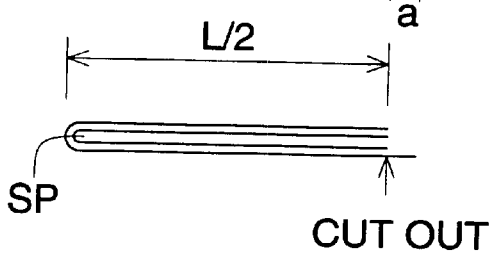

FIGS. 9(*a*)–9(*d*) are typical views showing processes of center stapling processing and folding processing.

Figure 10:
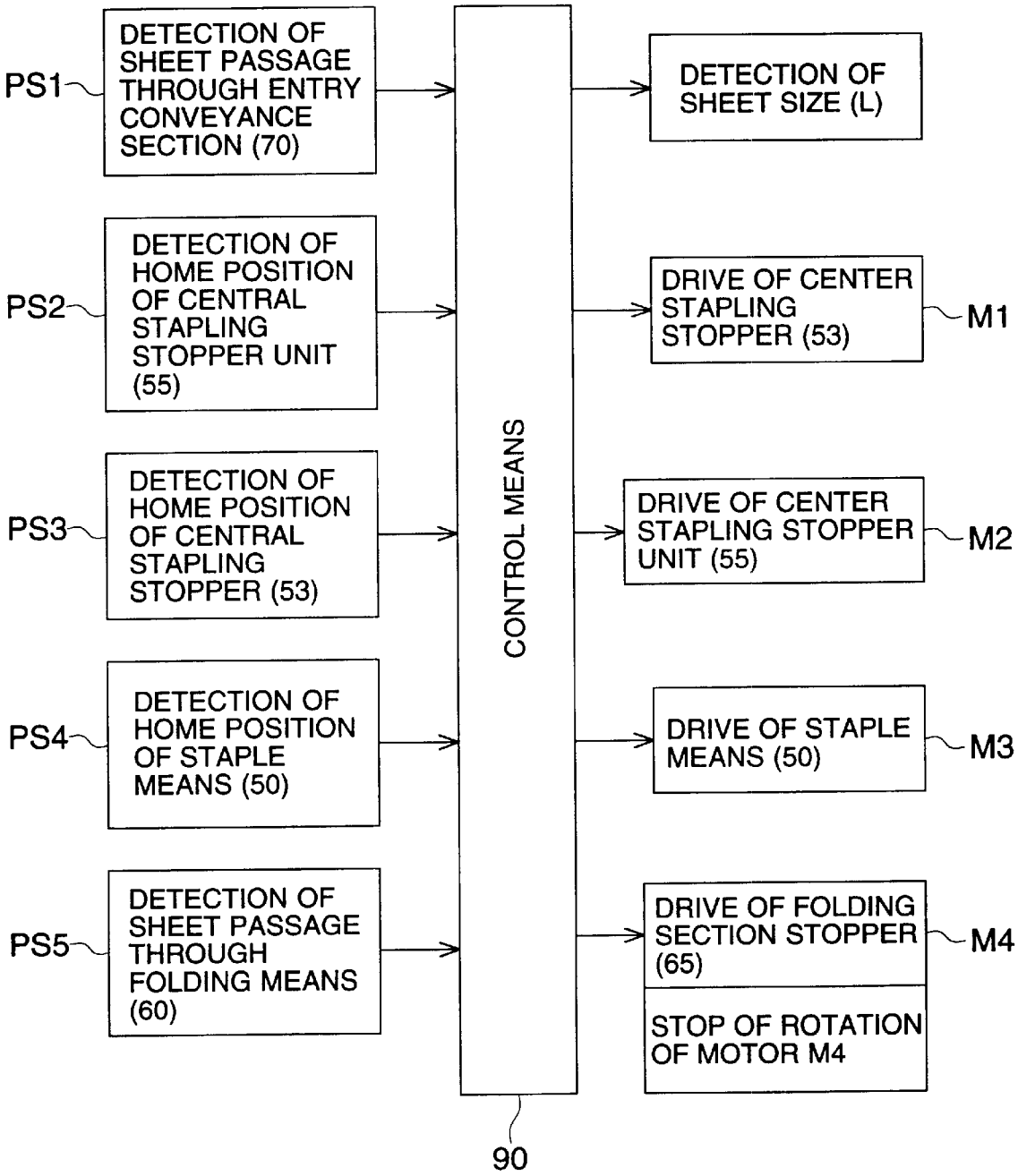
FIG. 10 is a block diagram showing the control of the sheet finisher.

FIG. 9(*a*) is a plan views of a plurality of sheets S1 and S2 which are stacked on the intermediate stacker 35 and edge arranged and center stapling processed by the center stapling stopper 53. FIG. 9(*b*) is front views of center stapling processed sheets S1 and S2. FIG. 9(*c*) is a front views of folding processed sheets S1 and S2. FIG. 10 is a block diagram showing the control of the sheet finisher FS.

Passage of sheet leading edge and passage of sheet trailing edge of a plurality of sheets sent from the image forming apparatus A into the sheet finisher FS are detected by the sheet passage sensor PS1 arranged in the vicinity of the receiving section 71 of the entry conveyance section 70 shown in FIG. 2.

In the control means 90, the length in the sheet conveyance direction (sheet size) for each passing sheet is measured by a sheet leading edge and trailing edge passage detection signal and a timer. In the control means 90, after sheet sizes of all sheets of one booklet have been measured, the minimum size L is set.

Next, according to the setting value of the minimum size L, the control means 90 moves the center stapling stopper 53 and sets its position so that the leading edge arrangement in which the stapling processing position (putting-in position of the stapler pin SP) is equal to ½ of the minimum size (L/2), can be carried out.

The control means 90 moves and sets the folding section stopper 65 of the folding means 60 shown in FIGS. 4 and 5 to the position in which the length of between the leading edge and a fold is equal to the L/2.

After center folding processing, end portions of the booklet is arranged to the leading edge of the minimum sized sheet, and the sheet longer than the minimum sized sheet is projected as an ear portion a. This ear portion a is cut on a basis of the short leading edge side arranged after twice-folding of the minimum sized sheet. In the booklet made of sheets after cutting, all of end portions of sheets are easily and uniformly arranged with the minimum cut-off dimension without depending on the sheet size (refer to FIG. 9(*d*)).

Incidentally, considering about irregular arrangement of the set of sheets or irregular arrangement of the trailing edge of thick set of sheets, the dimension after cutting may be set to several mm (1–2 mm) shorter dimension than the L/2.

A holding member 651 holding the folding section stopper 65 of the folding means 60 shown in FIGS. 4 and S is guided by a guide bar 652 and can move linearly. An auxiliary member 651 is moved by a timing belt, not shown, drive transmission system, and a motor M4.

The motor m4 is formed of a stepping motor. When the size (length in the sheet conveyance direction) of the sheet sent into the sheet finisher FS is detected, the motor m4 is driven, and the folding section stopper 65 is moved to a predetermined position corresponding to the sheet size, and stops. The center stapling processed set of sheets slides on the slantingly arranged guide plate 64 and collides with the stopped folding section stopper 65.

The folding section stopper 65 is a movable stopper for folding means by which the center stapling processed set of sheets conveyed on the guide plate (stack board) 64 of the folding means 60 is moved to a predetermined position in the sheet conveyance direction corresponding to the sheet size and the leading edge of the sheets are positioned, and is driven by the motor (stepping motor) M4, stepping motor driving means, control means 90, etc.

A detection means for detecting the entry of the set of sheets into the folding section stopper 65 is arranged on the bottom portion of the slantingly arranged guide plate 64. The detection means is composed of an actuator 653 and a photo-sensor PS5. The actuator 653 is supported by the guide plate 64 so that it can be oscillated, and is oscillated by being contacted with the leading edge portion in the advancing direction of the sheet S which slides down on the guide plate 64, thereby, the detection optical path of the photo-sensor PS5 is made off and on, and the passage of leading edge of the sheet S is detected.

A stepping motor driving means of the control means 90 controls such that the rotation of the stepping motor is stopped just before the leading edge portion of the set of sheets contacts with the folding section stopper 65, by the passage detection signal of the leading edge portion of the sheet S by the photo-sensor PS5.

Even when the center stapling processed thick set of sheets slides at high speed on the surface of the guide plate 64, and collides with the folding section stopper 65, the folding section stopper 65 is fixed electrically by the stepping motor M4, therefore, it can stand the impulse of the collision and is not moved from the predetermined position. Accordingly, the center folding processing is carried out at a correct position.

Figure 11:
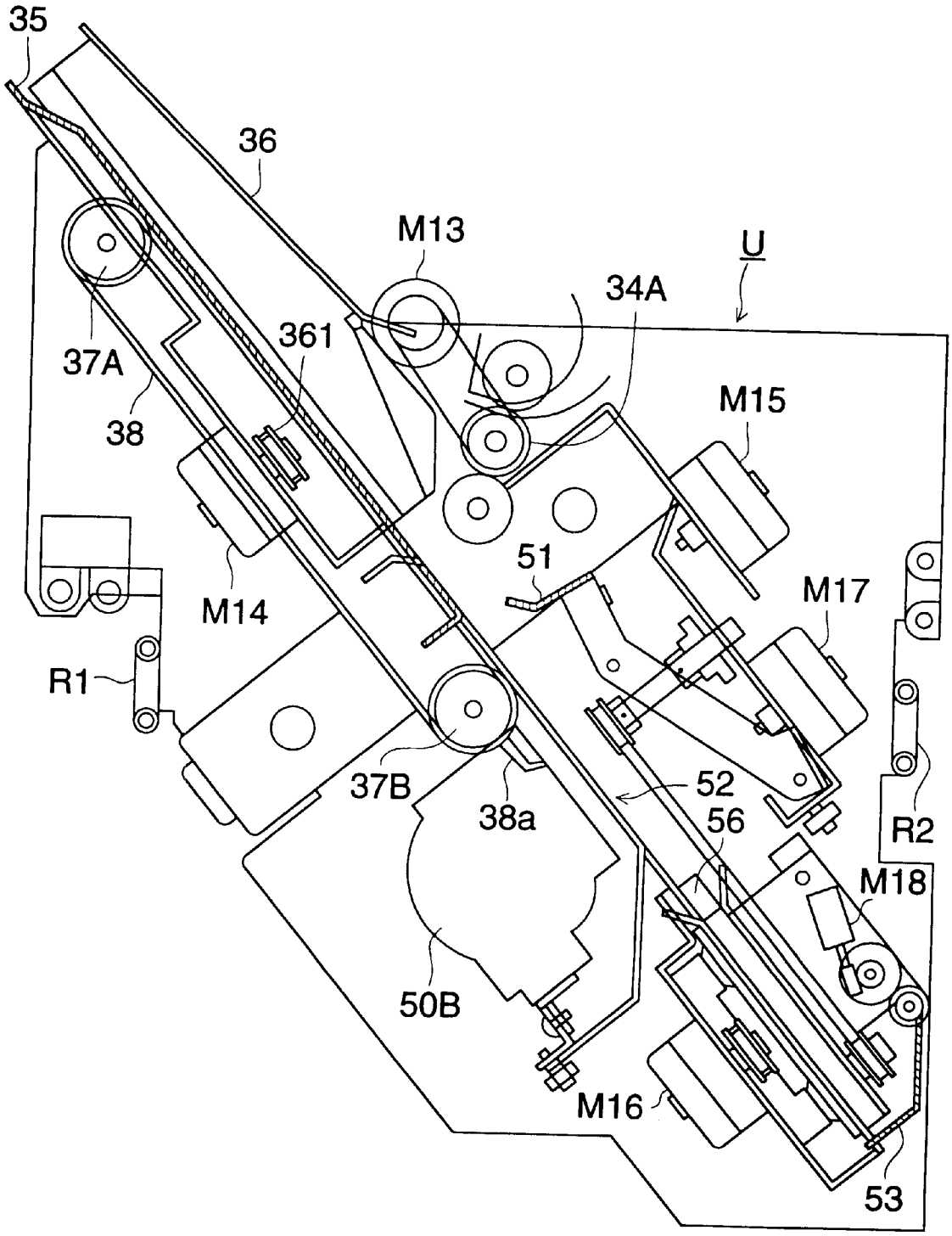
FIG. 11 is a font view of the stapling unit.
Figure 12:
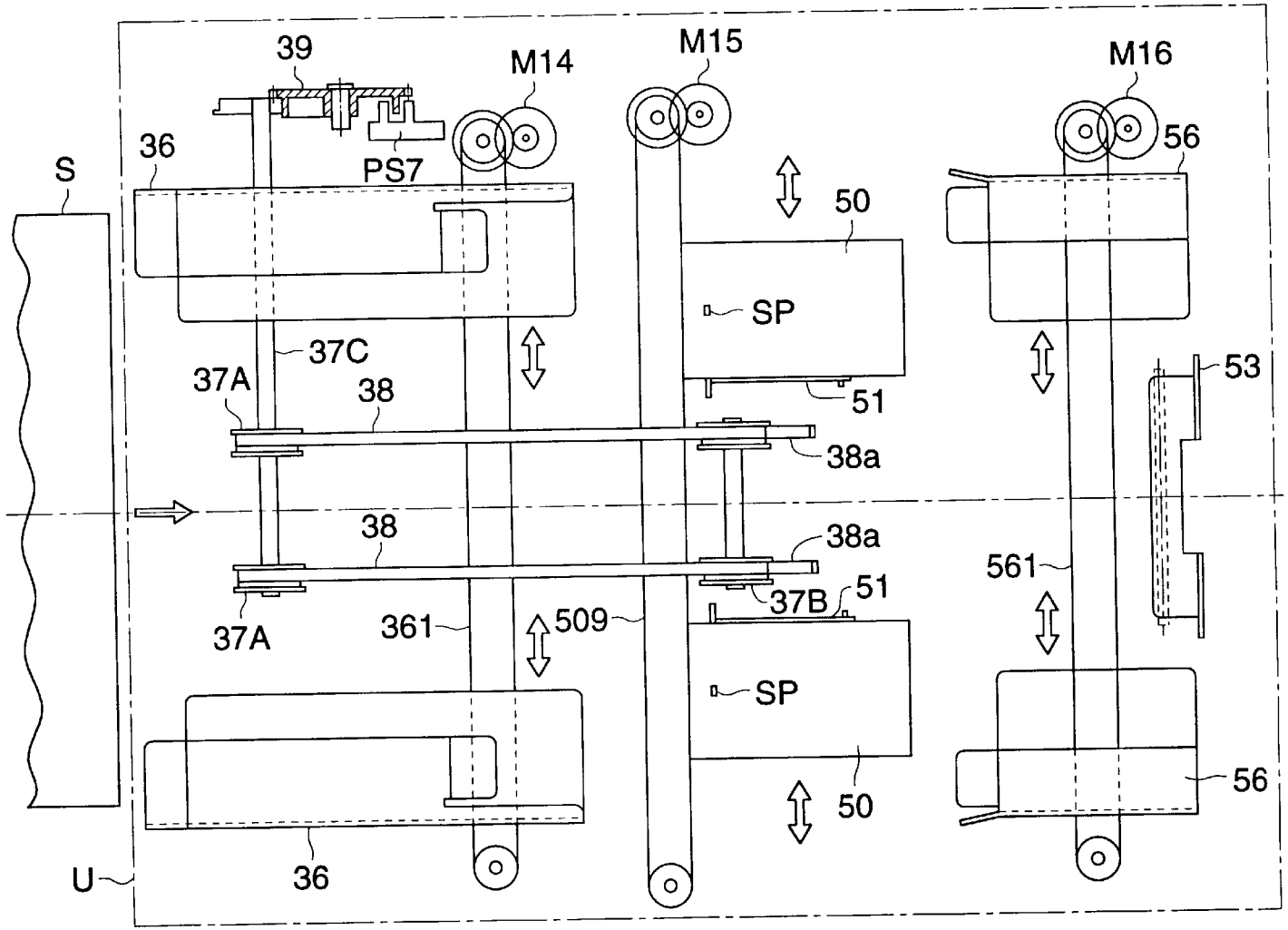
FIG. 12 is a plan view of a main portion of the above-described stapling unit.

FIG. 11 is a front view of the stapling section unit U, and FIG. 12 is a plan view of the stapling section unit U.

At least one set of stapler means 50 structured by the upper mechanism and lower mechanism which are separated upside and down side through the path 52 on which the recording sheets S and the cover sheet K can pass at the time of the center stapling processing; the upstream side width arrangement means 36 and downstream side width arrangement means 56 which arrange the width direction of sheets in the direction perpendicular to the sheet conveyance direction; the sheet edge portion positioning means composed of the edge stapling stopper 51 and center stapling stopper 53 which regulate the sheet end portion in the sheet conveyance direction; and the intermediate stacker 35 on which the set of sheets to be edge stapling processed and center stapling processed, is placed, are formed into a unit as the stapling section unit U.

The stapling section unit U can be drawn out from the sheet finisher main body in the direction perpendicular to the sheet conveyance direction. That is, being guided by a guide rails R1 and R2, the stapling section unit U can be drawn on the front side of the sheet finisher FS. When sheet conveyance failure, failure of component members, stapler failure, or the like, occurs in the sheet finisher FS, or when replenishment operation of the stapler pin, or maintenance operation is carried out, operations can be easily carried out by drawing out the stapling section unit U, thereby, safety and working property are increased.

As shown in FIG. 11, the driving means of the edge stapling stopper 51 to regulate the sheet end portion in the sheet conveyance direction at the time of the edge stapling processing, and the driving means of the center stapling stopper 53 to regulate the sheet end portion in the sheet conveyance direction, are arranged on the upper side of the sheet conveyance surface.

A drive transmission section composed of a motor M14 to drive the upstream side width arrangement means 36 for regulating the sheet width in the direction perpendicular to the sheet conveyance direction, a timing belt 361, etc., is arranged on the lower side of the sheet conveyance surface.

Further, the drive transmission section composed of a motor M16 to drive the downstream side width arrangement means 56, a timing belt 561, etc., is also arranged on the lower side of the sheet conveyance surface.

When driving sections of these width arrangement members are arranged on the lower side of the sheet conveyance surface, the space above the sheet placement section is widely opened, and when the sheet conveyance failure (jam) occurs in the vicinity of the sheet placement section, visual confirmation and taking out of the conveyance failure sheet are easily carried out, thereby, safety and working property are increased.

Figure 13:
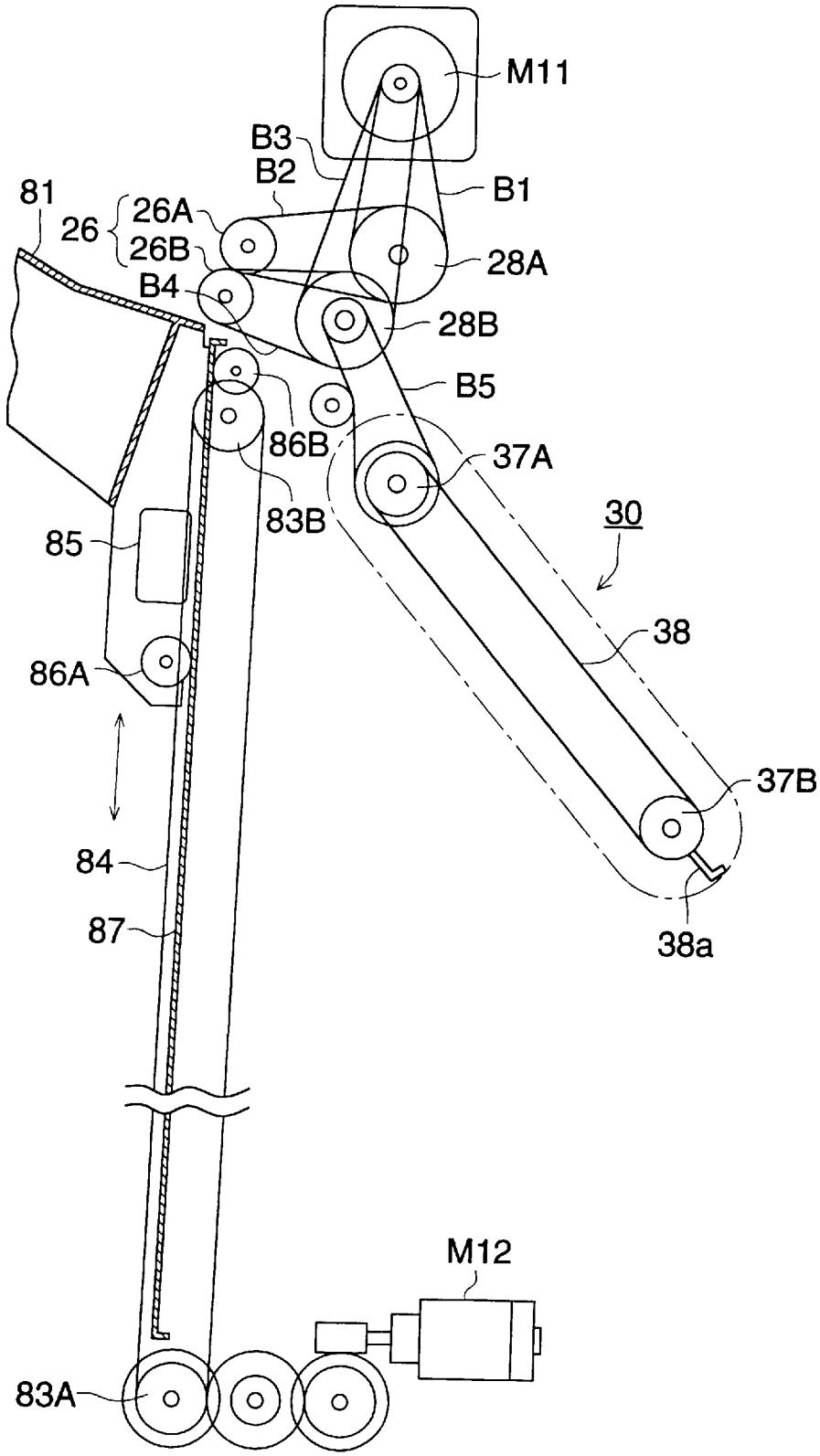
FIG. 13 is a structural view of a driving system to drive a delivery belt, delivery roller pair, and movable delivery tray of the sheet finisher.

FIG. 13 is a structural view of the driving system to drive the delivery belt 33, delivery roller pair 26 and movable delivery sheet tray 81 of the sheet finisher.

A motor M11 rotates an upper driving roller (hereinafter, called upper roller) 26A of a delivery roller pair 26 through timing belts B1 and B2, and an intermediate pulley 28A, and also rotates a lower driving roller (hereinafter, called lower roller) 26B of a delivery roller pair 26 through timing belts B3 and B4, and an intermediate pulley 28B. The motor M11 further rotates a drive pulley 37A through the intermediate pulley 28B and a timing belt B5, and rotates a delivery belt 38.

A motor M12 rotates a drive pulley 83A through a gear train shown in the drawing, and rotates a wire 84 trained around the drive pulley 83A and an upper driven pulley 83B. A base portion of the movable delivery sheet tray 81 is fixed on a portion of the wire 84 by an engagement member 85.

Rollers 86A and 86B rotatbly supported on a base portion of the movable delivery sheet tray 81 slide on a rail member 87, and the wire 84 is rotated by the motor M12, thereby, the movable delivery sheet tray 81 can move upward and downward along the rail member 87.

In the stapling unit U shown in FIGS. 11 and 12, 2 delivery belts 38 are rotated by the motor M11 (refer to FIG. 13). A motor M13 drives a driving roller 34A of a conveyance roller pair 34. A motor M14 moves 2 width arrangement members 36 on the upstream side, motor M15 moves 2 staple means 50, motor M16 moves 2 width arrangement members 56 on the downstream side, motor M17 indirectly drives the edge stapling stopper 51, and motor M18 drives the center stapling stopper 53.

A cam member 39 is rotatably engaged with a rotation shaft 37C of the drive pulley 37A. The cam member 39 has a cut-out cylindrical cam portion, and when the photo-sensor PS2 detects a protruded portion formed on a predetermined position of the cam portion, a standby position at the time of stoppage of a delivery claw 38*a* of the delivery belt 38 rotated by the motor M1 which is a driving source is set.

Figure 14:
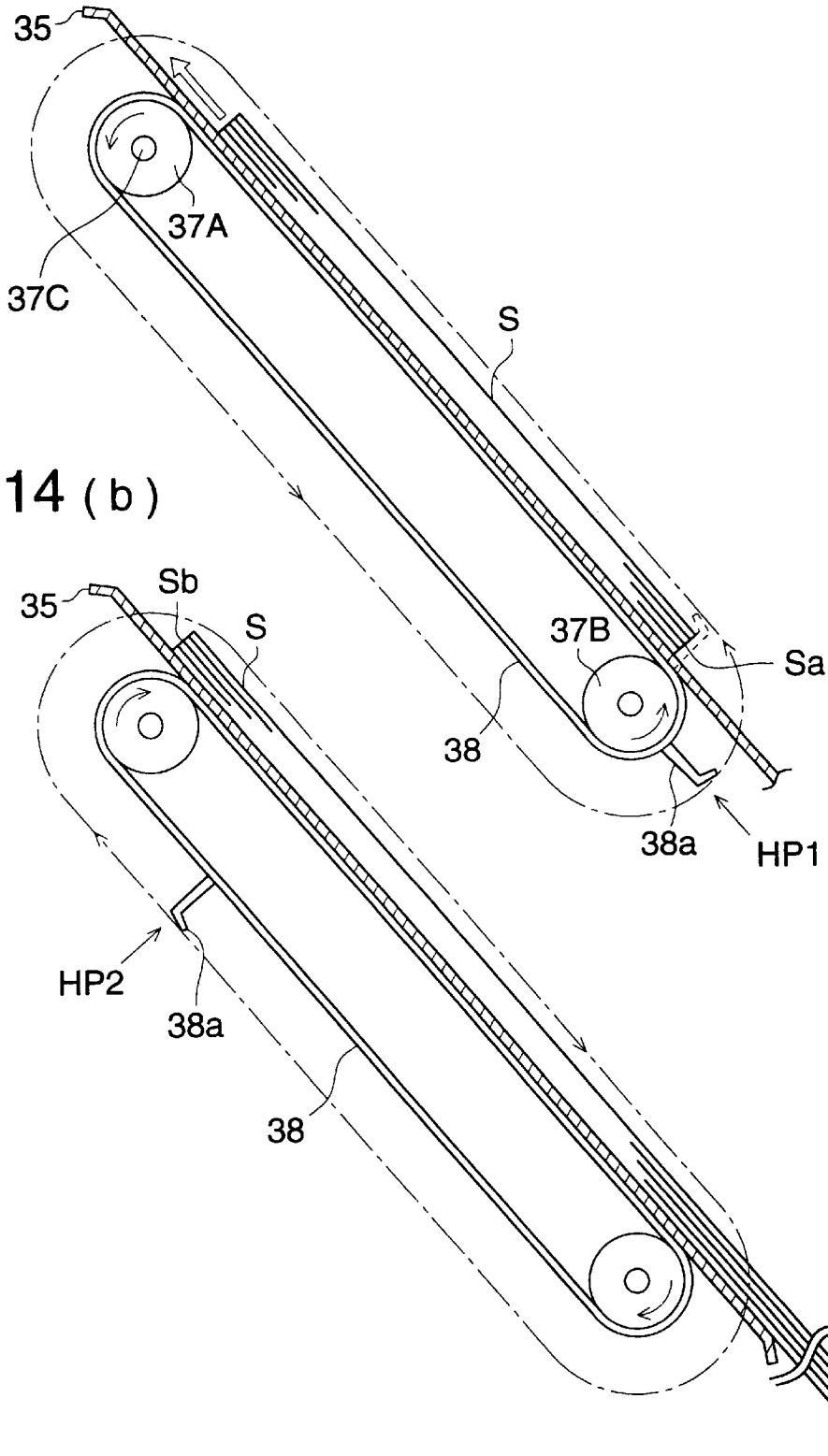
FIGS. 14(*a*) and 14(*b*) are sectional views in the vicinity of the delivery belt showing the delivery of a set of sheets after the edge stapling processing and the center stapling processing.

FIG. 14(*a*) is a sectional view in the vicinity of delivery belt showing delivery of edge stapling processed set of sheets. The trailing edge portion Sa in the advancing direction of recording sheets S which is positioned and stacked on the intermediate stacker 35 and edge stapling processed, is held by the delivery claw 38*a* fixed on one end of the delivery belt 38 which is rotated in the arrowed direction by the normal rotation of the motor M11, and slides on the intermediate stacker 35, and advances in the direction of a hollowed arrow in the slant upward portion by being pushed by the delivery claw 38*a*, and is delivered.

An initial standby position HP1 of the delivery claw 38*a* at the time of edge stapling processing, is set at the lower portion of the intermediate stacker 35, and at a position at which the delivery claw 38*a* is rotated and quickly brought into pressure-contact with the trailing edge portion Sa of the recording sheet S after the start of rotation of the delivery belt 38. The above-described initial standby position HP1 is positioned at an arbitrary position as a predetermined position, according to time-processing by a timer based on the detection by the cam member 39 shown in FIG. 12 and the photo-sensor PS7.

FIG. 14(*b*) is a sectional view in the vicinity of the delivery belt showing the state of conveyance of center stapling processed set of sheets to the next process. The trailing edge portion Sb in the advancing direction of recording sheets S, which is positioned and stacked on the intermediate stacker 35 and center stapling processed, is pushed by the delivery claw 38*a* fixed on one end of the delivery belt 38 which is rotated in the arrowed direction by the reversal rotation of the motor M11, and slides on the intermediate stacker 35, and advances in the direction of a hollowed arrow in the slant downward portion by being pushed by the delivery claw 38*a*, and is conveyed to the folding means 60 of the next process.

An initial standby position HP2 of the delivery claw 38*a* at the time of center stapling processing, is set at a position at which the delivery claw 38*a* is rotated and quickly brought into pressure-contact with the trailing edge portion Sb of the maximum sized recording sheet S in the sheet conveyance direction after the start of rotation of the delivery belt 38. The above-described initial standby position HP2 can be set at a arbitrary position as a predetermined position, according to time-processing by a timer based on the detection by the cam member 39 shown in FIG. 12 and the photo-sensor PS7.

Incidentally, an initial standby position HP2 of the delivery claw 38*a* at the time of center stapling processing can also be set to a plurality of predetermined positions corresponding to the sheet size signal. That is, in the case of small sized recording sheet S, when it is set at the lower portion of the intermediate stacker 35, and at a position at which the delivery claw 38*a* is rotated and quickly brought into pressure-contact with the trailing edge portion Sb of the recording sheet S after the start of rotation of the delivery belt 38, the sheet conveyance efficiency is further increased.

Figure 15:
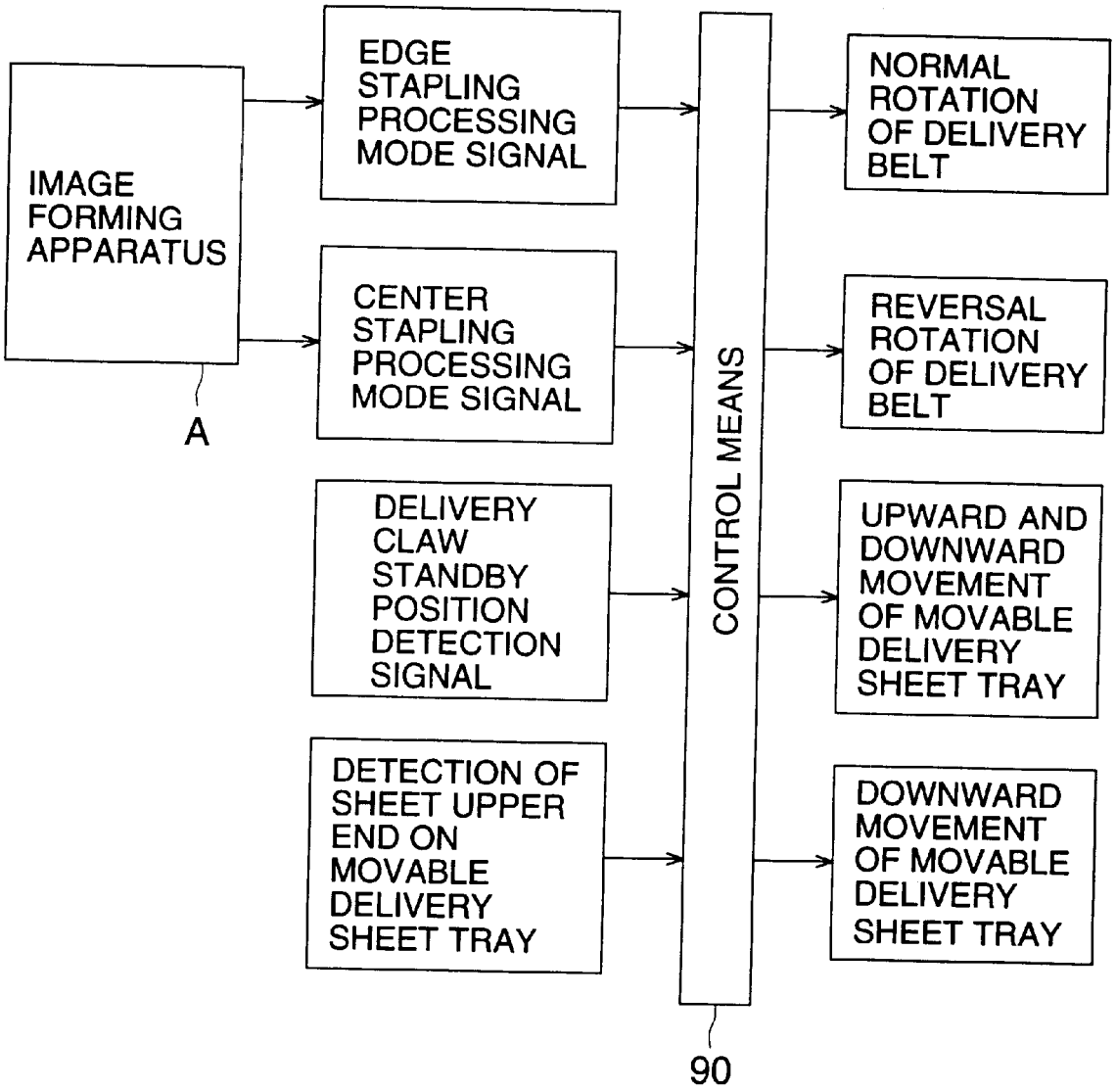
FIG. 15 is a block diagram of a control means for controlling the driving of the delivery belt and the movable delivery tray.

Above-described initial standby position HP1 of the delivery claw 38*a* at the time of edge stapling processing and an initial standby position HP2 of the delivery claw 38*a* at the time of center stapling processing are controlled by the control means 90 shown in FIG. 15.

FIG. 15 is a block diagram of the control means 90 for controlling the drive of the delivery belt 38 and the movable delivery sheet tray 81.

The recording sheet S set in the non-staple, non-sort mode (1), shift processing mode (2), and edge stapling mode (3) and conveyed, is stacked on the movable delivery sheet tray 81.

The position of the uppermost layer of the recording sheets S stacked on the movable delivery sheet tray 81 is detected by the photo-sensor PS6, and the movable delivery sheet tray 81 is controlled to move upward and downward so that the movable delivery sheet tray 81 can keep its height always constant corresponding to the stacked height of the recording sheet S (refer to FIG. 2).

In the sheet finisher by which both of edge stapling processing and center stapling processing can be conducted, when the edge stapling mode is set, the edge stapling processed set of sheets by the staple means 50 is delivered onto the movable delivery sheet tray provided outside the apparatus, by the normally rotating delivery belt 38 and normally rotating delivery roller pair 26 interlocked with the delivery belt 38.

When the center stapling processing mode is set, the delivery belt 38 is reversely rotated after the center stapling processing by the staple means 50, and when the delivery claw 38*a* pushes the end portion of the processed set of sheets and conveys it to the next process, the control means 90 drives the motor M12, and prior to the reversal rotation of the delivery belt 38, lowers the movable delivery sheet tray 81 from the predetermined position detected by the photo-sensor PS6. The lowered amount is about 10 mm.

In order to convey the center stapling processed set of sheets to the next twice-folding processing process, when the delivery belt 38 is reversely rotated, the delivery roller pair 26 is also reevrsely rotated. However, even when no-edge stapling processed recording sheet S exists on the movable delivery sheet tray 81, the uppermost layer of the recording sheet S is lowered together with the movable delivery sheet tray 81, and thereby, it is prevented that the end portion of the recording sheet S on the movable delivery sheet tray 81 is rolled in the delivery roller pair 26 and reversely moved into the apparatus, and a sheet damage occurs.

Figure 16:
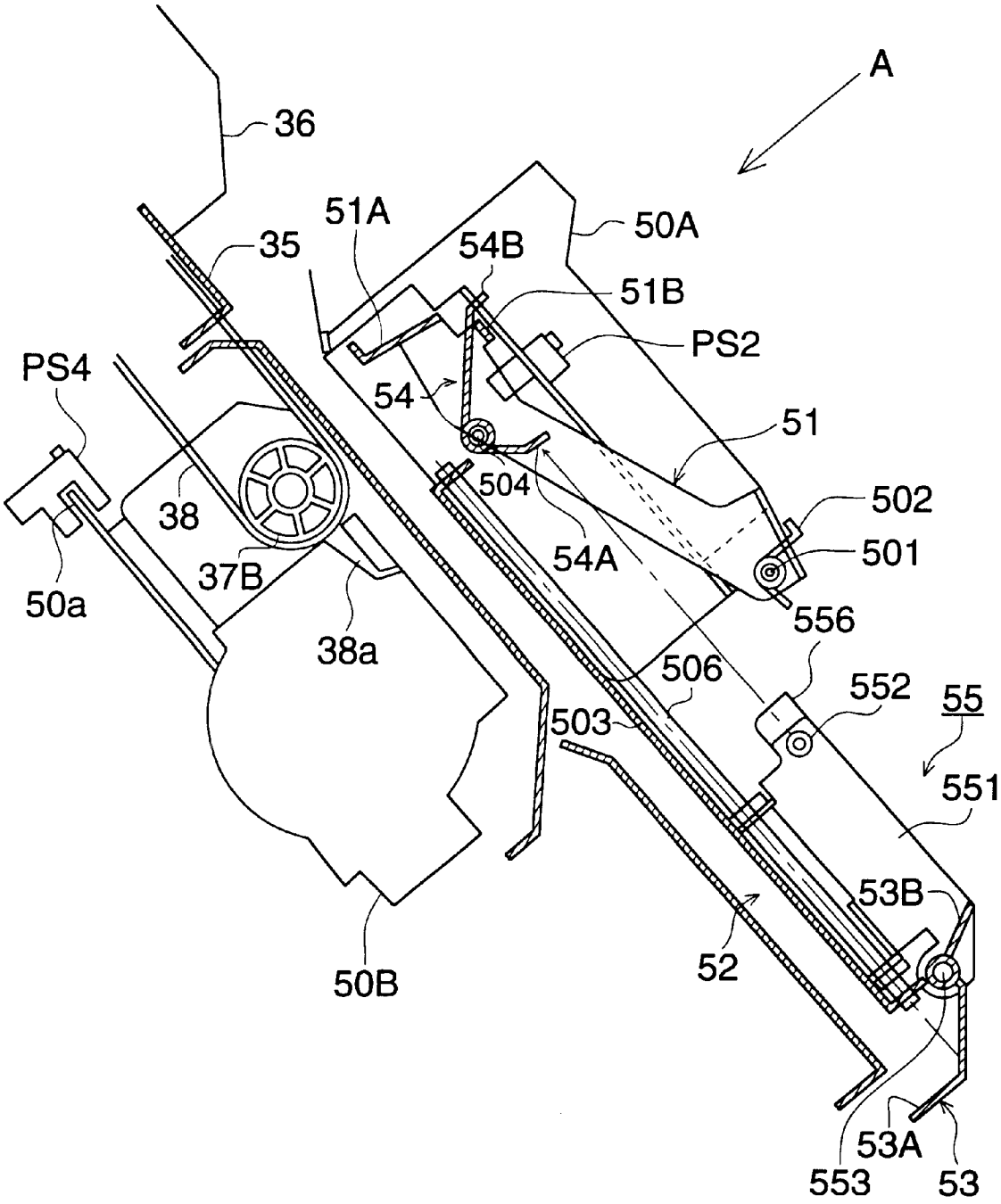
FIG. 16 is a sectional view of a staple processing section of the sheet finisher.
Figure 17:
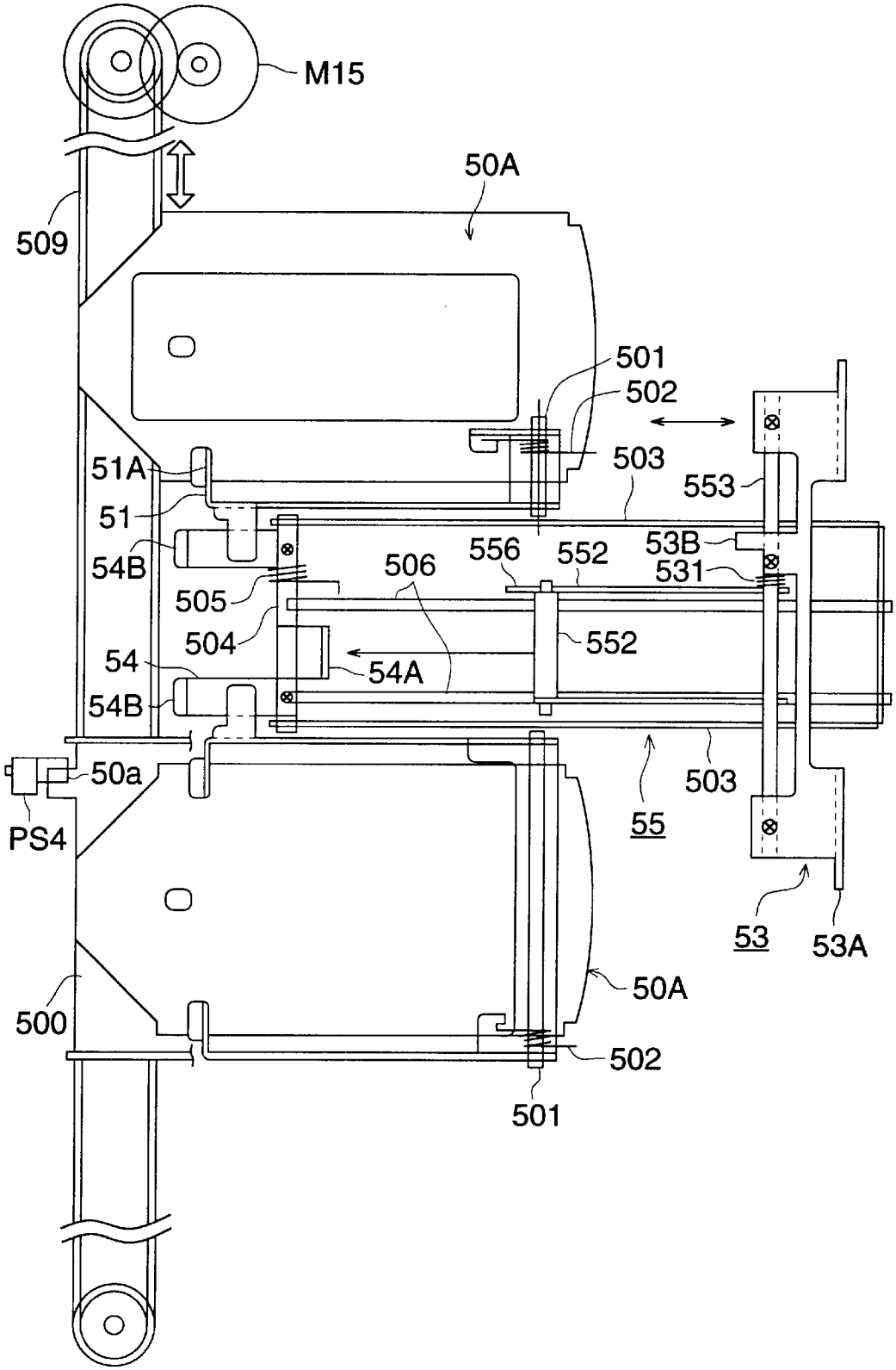
FIG. 17 is a plan view viewed in the direction of an arrow A of the stapling processing section in FIG. 16.

FIG. 16 is a sectional view of the stapling processing section of the sheet finisher, and FIG. 17 is a plan view viewed in the direction of an arrow of the stapling processing section in FIG. 16.

The stapling processing section has the staple means 50 which is divided into the upper mechanism 50A and the lower mechanism 50B, and a driving means for driving the edge stapling stopper 51 and the center stapling stopper 53.

Two sets of staple means 50 are arranged in the perpendicular direction of the sheet conveyance direction, and can move in the perpendicular direction of the sheet conveyance direction. By this staple means 50, the stapler pins are put into 2 straddled portions on the center line, in the sheet width direction, or one corner corresponding to the sheet size.

The edge stapling stopper 51 is supported by the upper mechanism 50A of the staple means 50, and integrally moved in the direction perpendicular to the sheet conveyance direction.

One leading edge portion of the edge stapling stopper 51 is a sheet leading edge contact surface 51A in the sheet conveyance direction, and the other leading edge portion is engaged with the support shaft 501 supported by the upper mechanism 50A of the staple means 50, and is supported so that it can be oscillated.

A torsion spring 502 is wound around the support shaft 501, and a sheet leading edge contact surface 51A side of the edge stapling stopper 51 is forced to the path 52 side by the spring, and stopped at sheet stop position at the time of edge stapling processing.

A support plate 503 fixed on the frame of the stapling section unit U is arranged at an intermediate position between the two staple means 50. A release lever 54 is supported so that it can be oscillated, on a support shaft 504 supported on the one end of the support plate 503.

A pressure shaft body 552 of the center stapling stopper unit 55, which will be described later, contacts with one lever portion 54A of the release lever 54 so that it can contact with and can be separated from the lever portion 54A. The other lever portion 54B of the release lever 54 presses the base portion of a sheet leading edge contact surface 51A of the edge stapling stopper 51, and lowers it to a predetermined stop position.

The torsion spring 505 wound around the support shaft 504 forces the release lever 54 and oscillates and stops it at a withdrawal stop position in the upper portion.

Two guide bars 506 whose both ends are supported by the support plate 503 fixed above the path 52, move the center stapling stopper unit 55 linearly.

A frame 551 of the center stapling stopper unit 55 has a bearing portion which slides on the 2 guide bars 506, and a detection portion 556 protruded on one end portion of the frame 551.

The pressure shaft body 552 is fixed in the vicinity of one end portion of the frame 551, and a support shaft 553 is fixed at the other end portion. The center stapling stopper 53 is engaged with the support shaft 553 and is oscillated. A torsion spring 531 is wound around the support shaft 553, and forces the center stapling stopper 53 in the direction that it is withdrawn from the path 52 toward the upper portion.

The lower end portion of the center stapling stopper 53 is a stopper surface portion 53A which contacts with the sheet leading edge portion and positions the set of sheets at the time of the center stapling processing. The upper end portion of the center stapling stopper 53 is a cam follower surface portion which contacts with the cam surface of the eccentric cam 555, which will be described later. The torsion spring 531 wound around the support shaft 553 forces the center stapling stopper 53 to press the cam surface of the eccentric cam 555.

Figure 18:
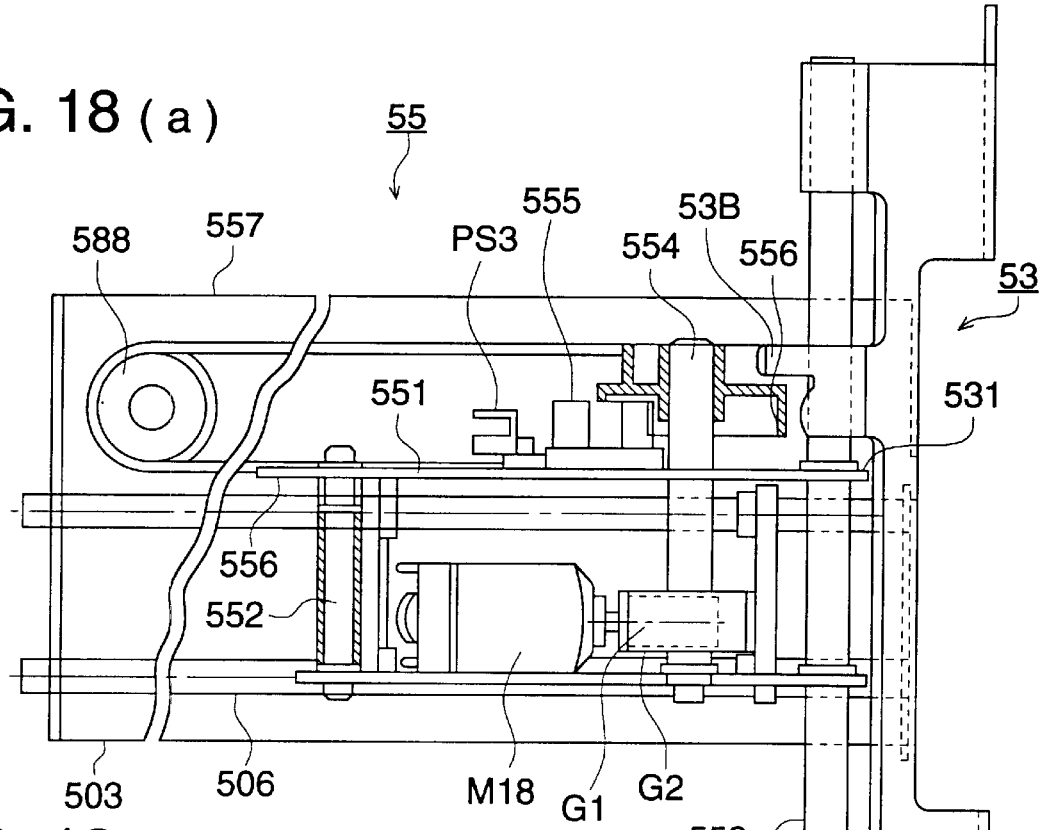
FIG. 18(*a*) is a plan view and 18(*b*) is a front view showing the driving system of a center stapling stopper unit.
Figure 18:
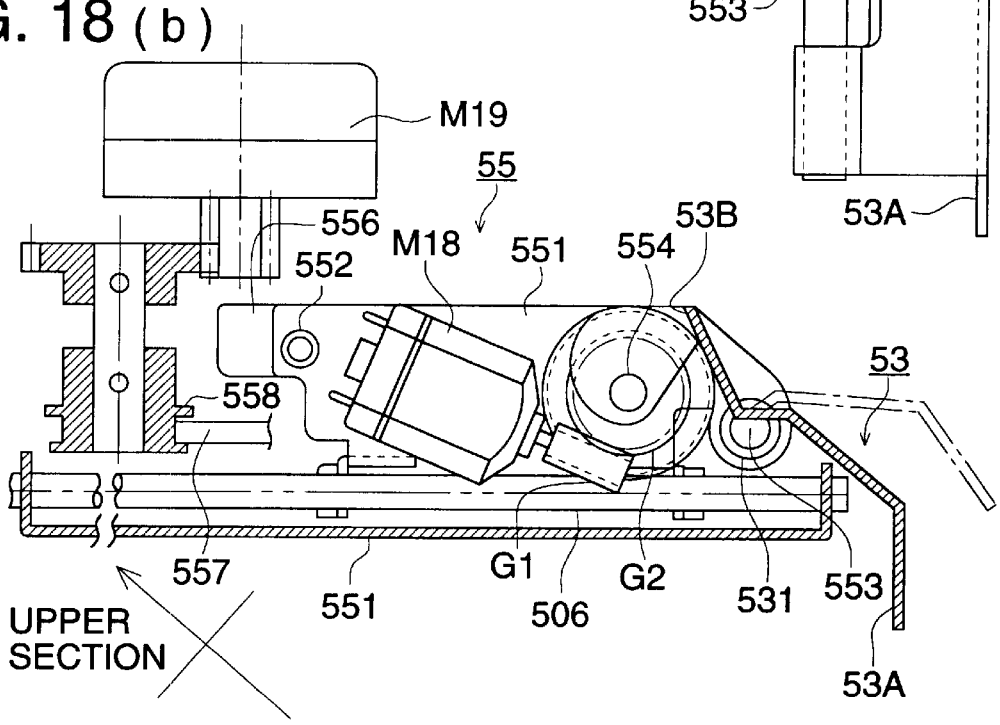

FIG. 18(*a*) is a plan view showing the drive system of the center stapling stopper unit 55, and FIG. 18(*b*) is a front view of the drive system of the center stapling stopper unit 55.

A gear G1 fixed on the drive shaft of the motor M18 fixed at the frame 551 is engaged with the gear G2 fixed on the one end of the cam shaft 554 rotatably supported by the frame 551. The eccentric cam 555 and the home position detecting section 556 are integrally formed and fixed at the other end of the cam shaft 554.

The home position detection 556 has the shape in which a cutout portion is provided on a portion of the hollow cylindrical surface , and by the cutout portion detection by the photo-sensor PS3, the home position of the center stapling stopper 53 is corrected.

A timing belt 557 is engaged by an engagement member, not shown, on the side surface of the frame 551. A timing pulley 558 around which the timing belt 557 is wound, is rotated through a driving transmission system such as a gear train by the motor M19 of the drive source.

Figure 19:
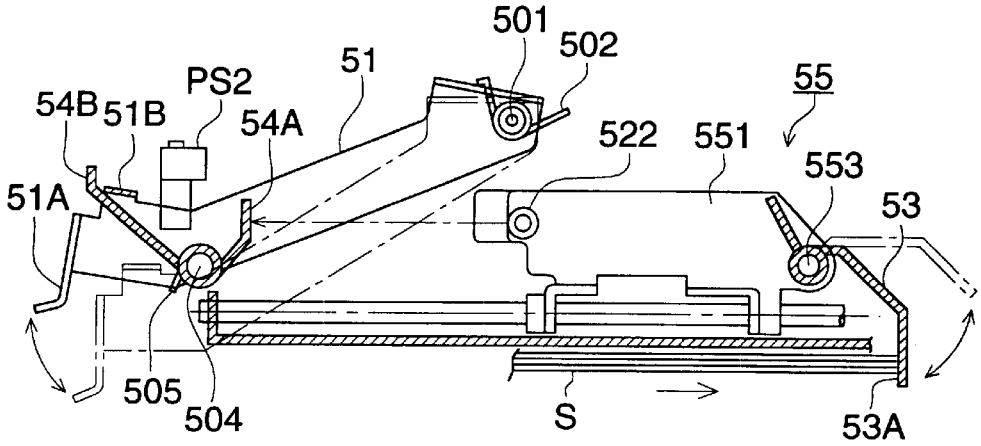
FIGS. 19(*a*) and 19(*b*) are plan views showing an interlocking mechanism of an edge stapling stopper with the center stapling stopper, and FIGS. 19(*c*) to 19(*e*) each is a plan view showing a stapling processing position and a stopper position of the sheet.
Figure 19:
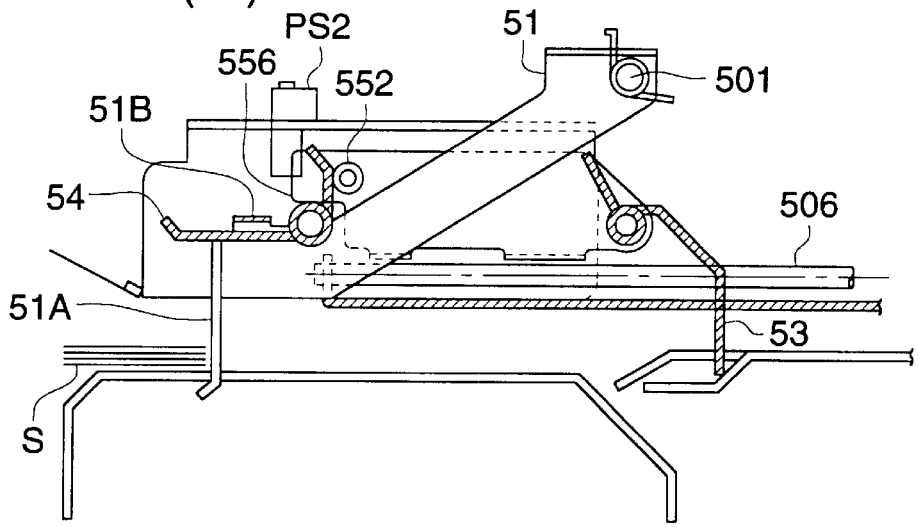
Figure 19:
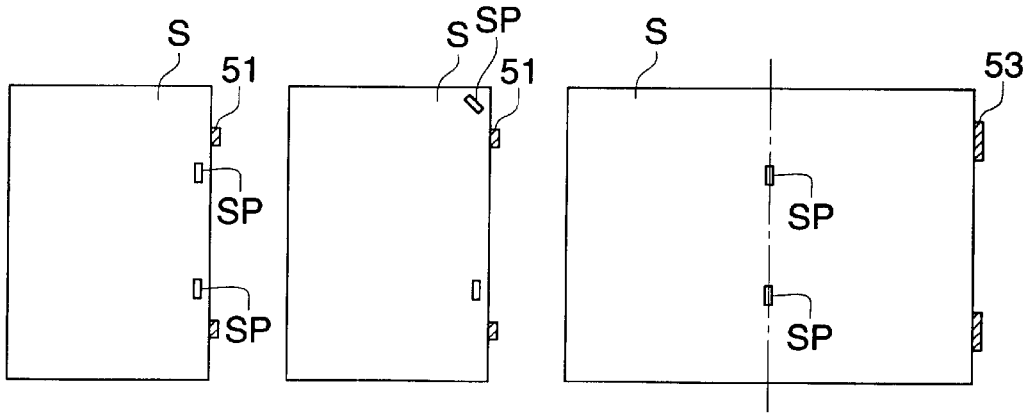

FIG. 19(*a*) and (*b*) are front views showing interlock mechanisms of the edge stapling stopper 51 with the center stapling stopper 53.

FIG. 19(*a*) is a front view showing the time of the center stapling processing. At the time of the center stapling processing, the center stapling stopper unit 55 is moved to the predetermined position in the sheet conveyance direction corresponding to the sheet size by the drive mechanism composed of the drive source, not shown, the timing pulley 558, the timing belt 557, etc., and stops.

At this stop position, the center stapling stopper 53 is driven by the motor M18 and oscillated, and held at the stopped condition shown in the drawing, and can arrange the leading edges of the sheets. After center stapling processing, the center stapling stopper 53 is oscillated by the reversal drive of the motor M18, and is withdrawn to a position shown by a dashed line in the drawing.

Further, at the stop position of the center stapling processing, the edge stapling stopper 51 is urged by the torsion spring 502, and forced counterclockwise shown in the drawing, around the support shaft 501, however, by the release lever 54 urged by a torsion spring 505 having stronger urging force than that of the torsion spring 502, the other lever portion 54B presses an engagement portion 51B, and oscillates the edge stapling stopper 51, and the edge stapling stopper 51 is stopped at a predetermined withdrawal position. Incidentally, the release lever 54 is urged by the torsion spring 505, and is oscillated clockwise in the drawing, around the support shaft 504, and is pressure-contacted with the engagement portion 51B of the edge stapling stopper 51.

FIG. 19(*b*) shows the time of edge stapling processing. At the time of edge stapling processing, the center stapling stopper unit 55 is moved along the guide bar 506 by the drive mechanism, and stopped. That is, when the home position detection section 556 of the moving center stapling stopper unit 55 is in proximity to the detection position of the photo-sensor PS2, the pressure shaft body 552 contacts with one lever portion 54A of the release lever 54.

When the center stapling stopper unit 55 overcomes the torque of the torsion spring 505, and further advances and continuously presses the lever portion 54A and oscillates it, the other lever portion 54B is also oscillated, and presses the upper end portion of the edge stapling stopper 51, and lowers it. By this lowering operation, the edge stapling stopper 51 in the upper withdrawal position is oscillated counterclockwise as shown in the drawing around the support shaft 501, and the sheet leading edge contact surface 51A is stopped at a predetermined sheet arrangement position for edge stapling processing. The center stapling stopper unit 55 stops when the home position detection section 556 reaches the photo-sensor PS2. At this time, setting of the edge stapling stopper 51 is completed.

Incidentally, because the torque of the torsion spring 505 of the release lever 54 is set to be larger than that of the torsion spring 502 of the edge stapling stopper 51, the torsion spring 505 of the release lever 54 overcomes the urging force of the torsion spring 502, and the edge stapling stopper 51 is lifted to the upper withdrawal position.

As described above, according to the movement direction of the center stapling stopper unit 55, the sheet stop of the center stapling processing and the sheet stop of the edge stapling processing are selected, thereby, the driving mechanism becomes simple and reliable.

FIG. 19(*c*) is a plan view showing the edge stapling processing in which the stapler pins SP are put into 2 straddled portions on the center line in the vicinity of the end portions of the recording sheets S.

FIG. 19(*d*) is a plan view showing the edge stapling processing in which the stapler pins SP are put into one portion in the vicinity of a corner portion of the recording sheet S.

FIG. 19(*e*) is a plan view showing the center stapling processing in which the stapler pins SP are put into 2 straddled portions on the center line, along a fold of the recording sheet S.

Herein, the initialization of the drive source in the interlocking mechanism of the center stapling stopper 53 and the edge stapling stopper 51 will be described below.

When the power source of the sheet finisher FS is turned on, initially, the motor M18 shown in FIG. 18 starts the rotation, rotates the home position detection section 556, and by the detection by the photo-sensor PS3, the home position of the center stapling stopper 53 is corrected, and then, the motor M18 is stopped.

Next, the center stapling stopper unit 55 shown in FIG. 18 is driven by the motor M19, and is moved to the edge stapling stopper 51 side (in the direction of one dotted chain line in FIG. 19(*a*)), and the pressure shaft body 552 presses the lever portion 54A of the release lever 54, lowers the lever portion 54B, and moves the home position detection section 556 of the leading edge portion of the frame 551 to the detection position of the photo-sensor PS2, and the home position detection of the center stapling stopper unit 55 is carried out, and the center stapling stopper unit 55 is initialized.

After the initialization by the movement of the center stapling stopper unit 55, the initialization of the staple means 50 provided with the edge stapling stopper 51 is conducted.

In FIGS. 16 and 17, a detecting portion 50*a* is protruded on the leading edge portion of a base plate 500 of the lower mechanism 50B of the staple means 50. The detecting portion 50*a* is position-detected by the photo-sensor PS4 fixed in the stapling section unit U, and detects the home position of the staple means 50.

The power source of the sheet finisher FS is turned on, and after the initialization of the center stapling stopper unit 55, the staple means 50 positioned outside the home position, is moved in the direction perpendicular to the sheet conveyance direction, through the motor M15, drive transmission system, timing belt 509, etc., and stops at the home position.

At this home position, after the initialization, the edge stapling stopper 51 is pressed by the release lever 54 and is moved and stops at a predetermined position, and blocks the path 52 and thereby, the edge stapling processing can be carried out.

If the order of the initialization is reverse to the above description, that is, when, initially, the movement of the staple means 50 to the home position is carried out, and then, the movement of the center stapling stopper unit to the home position is carried out, if the center stapling stopper unit 55 is moved outside the home position, engagement of the lever portion 54B of the release lever 54 with the engagement portion 51B of the edge stapling stopper 51 equipped in the staple means 50 is disengaged, and there is a possibility that interference occurs.

FIG. 20(*a*) is a plan view showing the center stapling processing of a set of recording sheets of each sized sheet.

The leading edge portion of each sized recording sheet (A3, B4, A4R, or similar size) S is brought into contact with the center stapling stopper 53 which is movable corresponding to each sheet size, and the leading edges of the sheets in the conveyance direction are positioned. Both side ends of the recording sheets S are positioned at a symmetrical position with the center line CL in the sheet conveyance direction by a pair of upstream side movable width arrangement means 36 and a pair of downstream side movable width arrangement means 56.

Two sets of staple means 701 and 702 are arranged in parallel at a symmetrical positions with the center line CL in a straddled manner with a predetermined distance (for example, 165 mm) between them.

Two sets of staple means 701 and 702 respectively put the stapler pins SP1 and SP2 into a fold of a central portion (center fold line)a in a conveyance direction of recording sheets of each size (A3, B4, A4R size).

FIG. 20(*b*) is a plan view showing 2 portions edge stapling processing on the set of recording sheets of each sized recording sheet.

The leading edge portions of recording sheets S of each size (A3, B4, A4R size) is brought into contact with the edge stapling stopper 51 protruded at a predetermined position, and the leading edge in the conveyance direction is positioned. Two sets of staple means 701 and 702 respectively put the stapler pins SP1 and SP2 into predetermined positions (for example, 165 mm) in the vicinity of the leading edge position of recording sheets of each size (A3, B4, A4R size).

FIG. 20(*c*) is a plan view showing 2 portions edge stapling processing on recording sheets of each size (A4, B5, A5 size).

Figure 21:
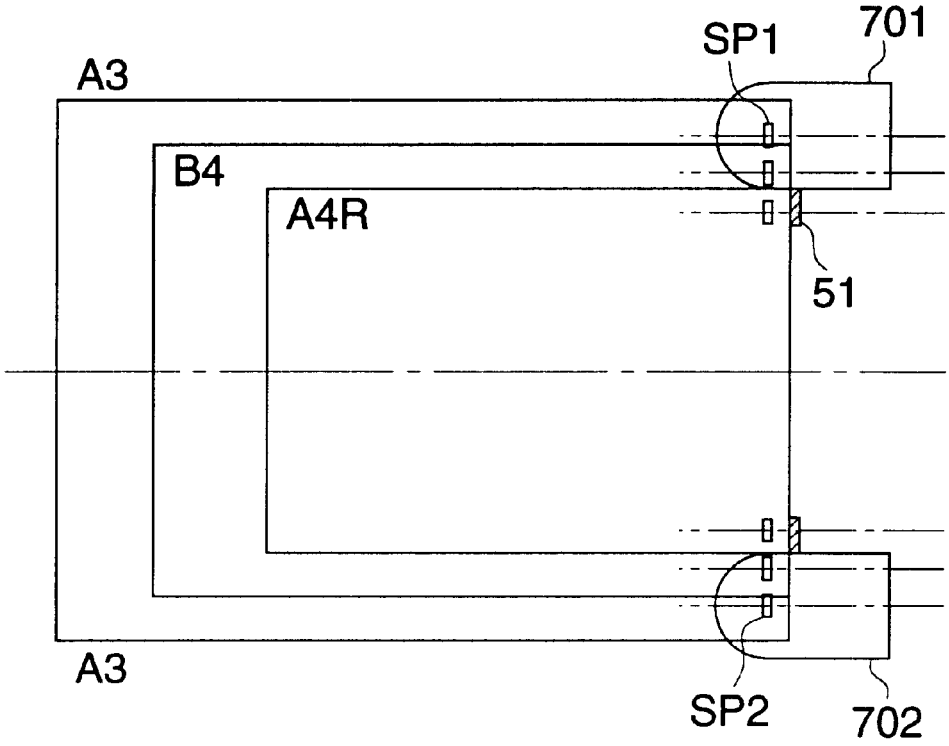
FIGS. 21(*a*) and 21(*b*) each is a plan view showing another embodiment showing the two-portion edge stapling processing.
Figure 21:
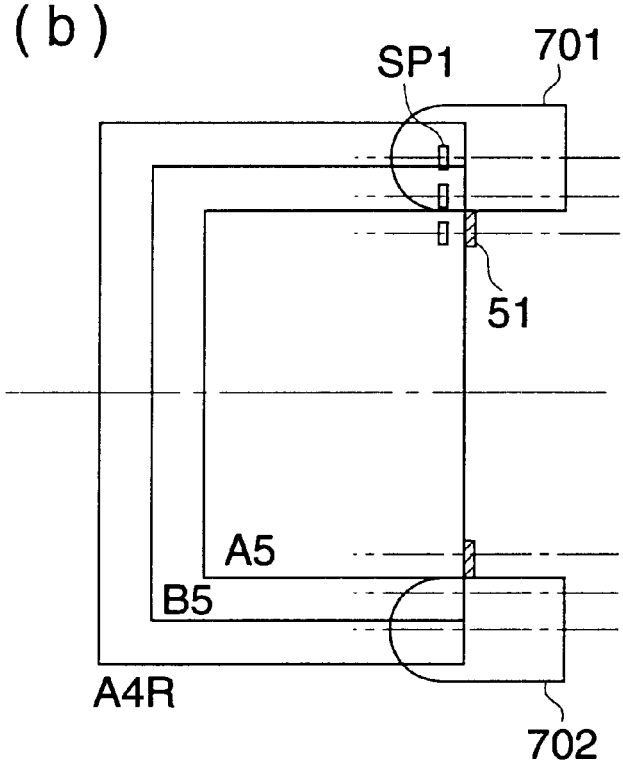

FIG. 21(*a*) is a plan view showing another embodiment which shows 2 portions edge stapling processing on recording sheets of each size.

The 2 sets of staple means 701 and 702 can simultaneously move in the direction of width of recording sheets S by the driving means, which will be described later, and respectively put the stapler pins SP1, and SP2, into predetermined positions in the vicinity of both end portions of recording sheets of each size (A3, B4, A4R size).

FIG. 21(*b*) is a plan view of another embodiment showing edge stapling processing on recording sheets of each size (A4, B5, A5 size) in 2 portions in the vicinity of both end portions.

Incidentally, in FIGS. 21(*a*) and 21(*b*), only the staple means 702 on this side is driven, and the one portion edge stapling processing can also be conducted on only one end portion of the recording sheets of each size.

Figure 22:
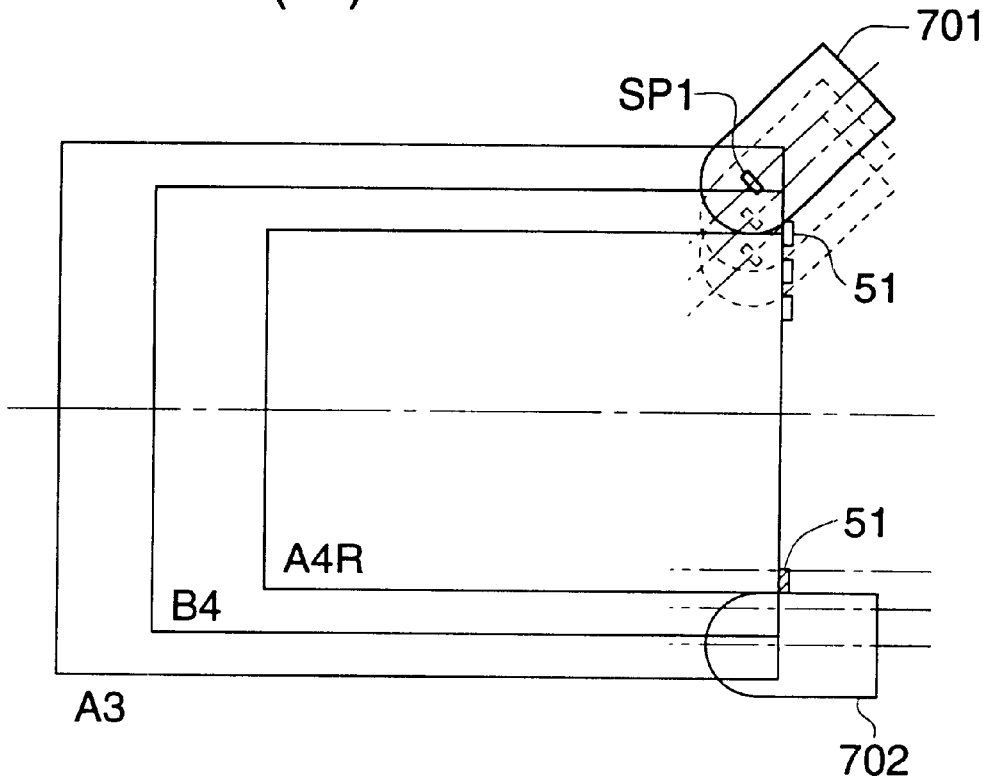
FIGS. 22(*a*) and 22(*b*) each is a plan view showing a one-portion slant edge stapling processing.
Figure 22:
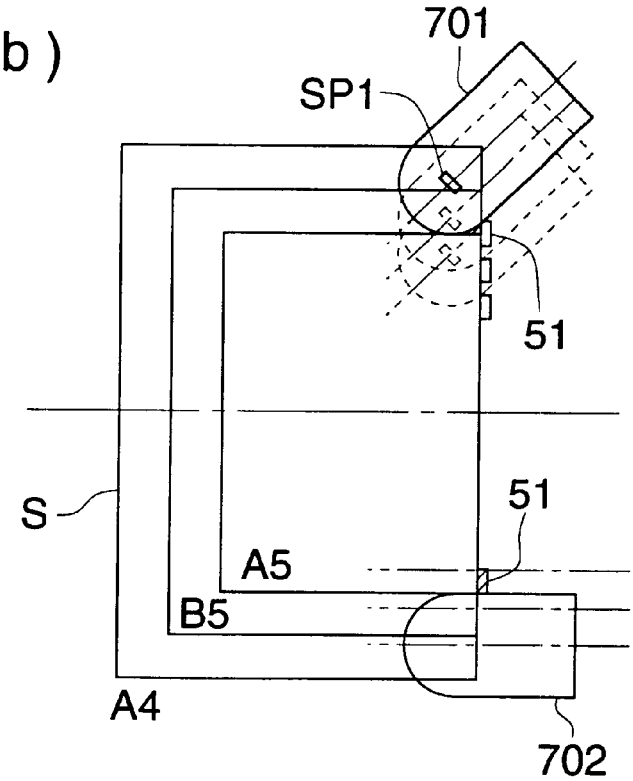

FIG. 22(*a*) is a plan view showing one portion slant edge stapling processing on recording sheets of each size.

The 2 sets of staple means 701 and 702 can simultaneously move in the direction of width of recording sheets S corresponding to recording sheets of each size (A3, B4, A4R size) by the driving means, which will be described later, and the staple means 701 on the far side moves in the width direction of the recording sheets and stops at a corner position of the recording sheet S, after that, it is driven by rotation angle of 45°, and puts the stapler pin SP1 into the sheets.

FIG. 22(*b*) is a plan view showing a condition that slant edge stapling processing is conducted on a portion of a corner portion of recording sheets of each size (A4, B5, A5 size).

Incidentally, in FIGS. 22(*a*) and 22(*b*), the staple means 702 on this side is also driven, and one portion slant edge stapling processing can also be conducted on another corner portion of recording sheets S.

Figure 23:
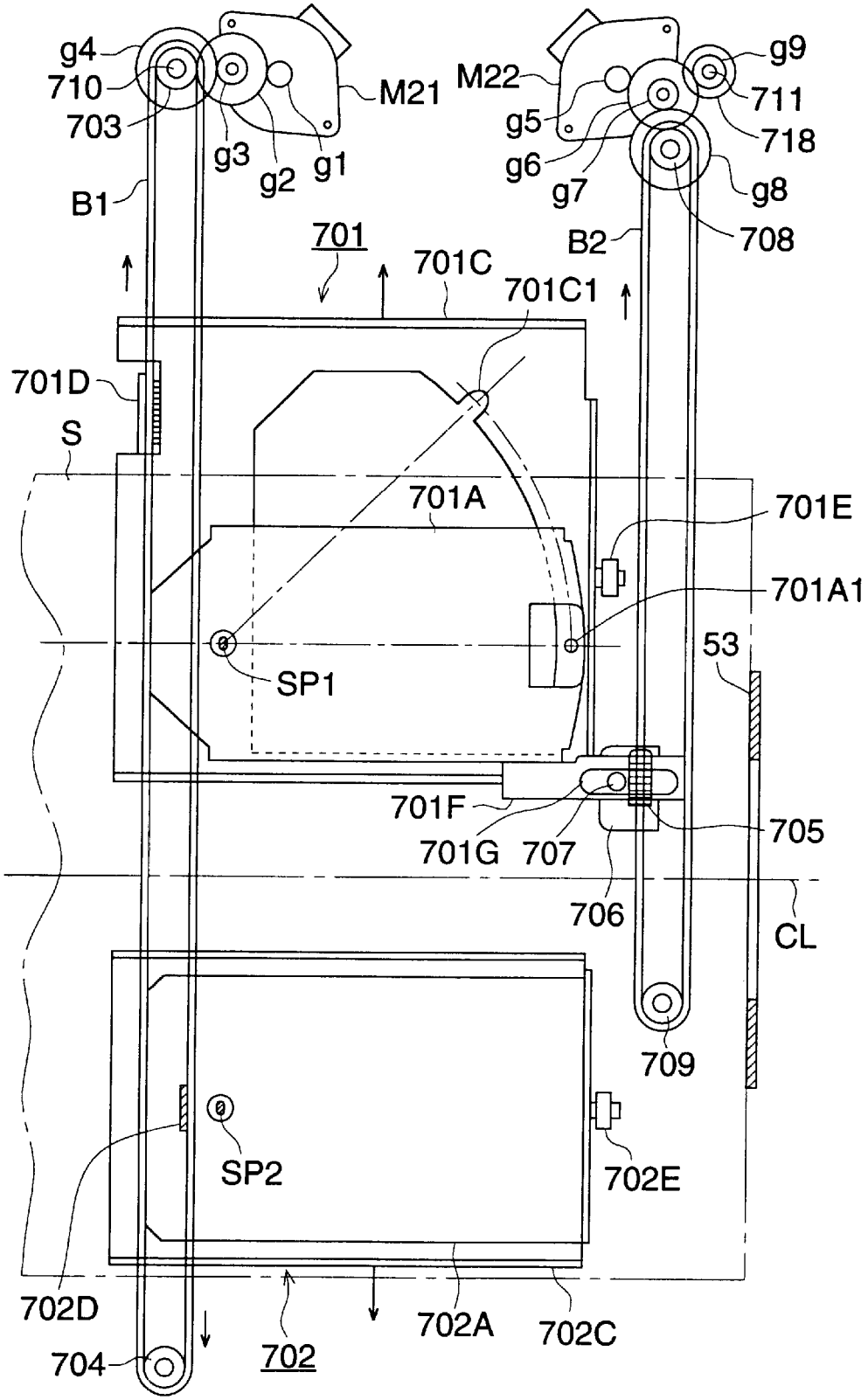
FIG. 23 is a plan view of a driving means of the staple means.

FIG. 23 is a plan view showing the driving means of upper mechanisms 701A and 702A of the 2 sets of stapler means 701 and 702.

The upper mechanism (the driven side mechanism for the staple pin clinch) 701A of the staple means 701 on the far side is mounted on a carriage 701C. The vicinity of leading edge portion of the carriage 701 is fixed on the rotating timing belt B1 by an engagement member 701D. A rotatable roller 701 E is supported in the vicinity of the trailing edge portion of the carriage 701C, and rotates on the base plate surface, not shown. The upper mechanism 701A can move in the width direction of recording sheets S (in the direction perpendicular to the recording sheet conveyance direction) together with the carriage 701C.

The timing belt B1 is wound around a drive pulley 703 and a driven pulley 704 and can be rotated. The drive pulley 703 is driven by a motor M21 through gears g1, g2, g3, and g4.

A regulation plate 701F on which a long groove portion 701G is provided, is integrally formed in the vicinity of the trailing edge member of the upper mechanism 701A. A pin 707 protruded on a movement member 706 slides in the long groove portion 701G. The movement member 706 is fixed on the timing belt B2 by a engagement member 705.

The timing belt B2 is wound around a drive pulley 708 and a driven pulley 709 and can be rotated. The drive pulley 708 is driven by a motor M22 through gears g5, g6, g7, and g8.

The upper mechanism (the driven side mechanism for the staple pin clinch) 702A of the staple means 702 on this side is mounted on a carriage 702C. The vicinity of leading edge portion of the carriage 702 is fixed on the rotating timing belt B1 by an engagement member 702D. A rotatable roller 702 E is supported in the vicinity of the trailing edge portion of the carriage 702C, and rotates on the base plate surface, not shown. The upper mechanism 702A can move in the width direction of recording sheets S (in the direction perpendicular to the recording sheet conveyance direction) together with the carriage 702C.

The carriage 701C on the far side and the carriage 702C on this side which are engaged with the timing belt B1, are simultaneously moved by the drive of the motor M1, and respectively advances in the opposite direction to each other, symmetrically about the center line CL.

The upper mechanism 701A of the staple means 701 on the far side can conduct parallel stapling on the sheet end portion and slant stapling on the sheet end portion, and each stop position, it is positioned and fixed by click-stop mechanism.

That is, a lock pin 701A1 urged by a spring, is provided on the trailing edge portion of the upper mechanism 701A of the staple means 701 on the far side, and engaged in a lock hole, provided just below the lock pin, not shown, and provided on the carriage 701C, and the stationary position of the upper mechanism 701A is held. In this position, parallel stapling on the sheet end portion can be conducted.

When the upper mechanism 701A is rotated by the motor M22, the lock pin 701A1 is engaged with a lock groove 701C1 provided on the carriage 701C, and the stationary position of the upper mechanism 701A is held. At this position, the slant stapling on the sheet end portion can be conducted (refer to FIG. 26).

Figure 24:
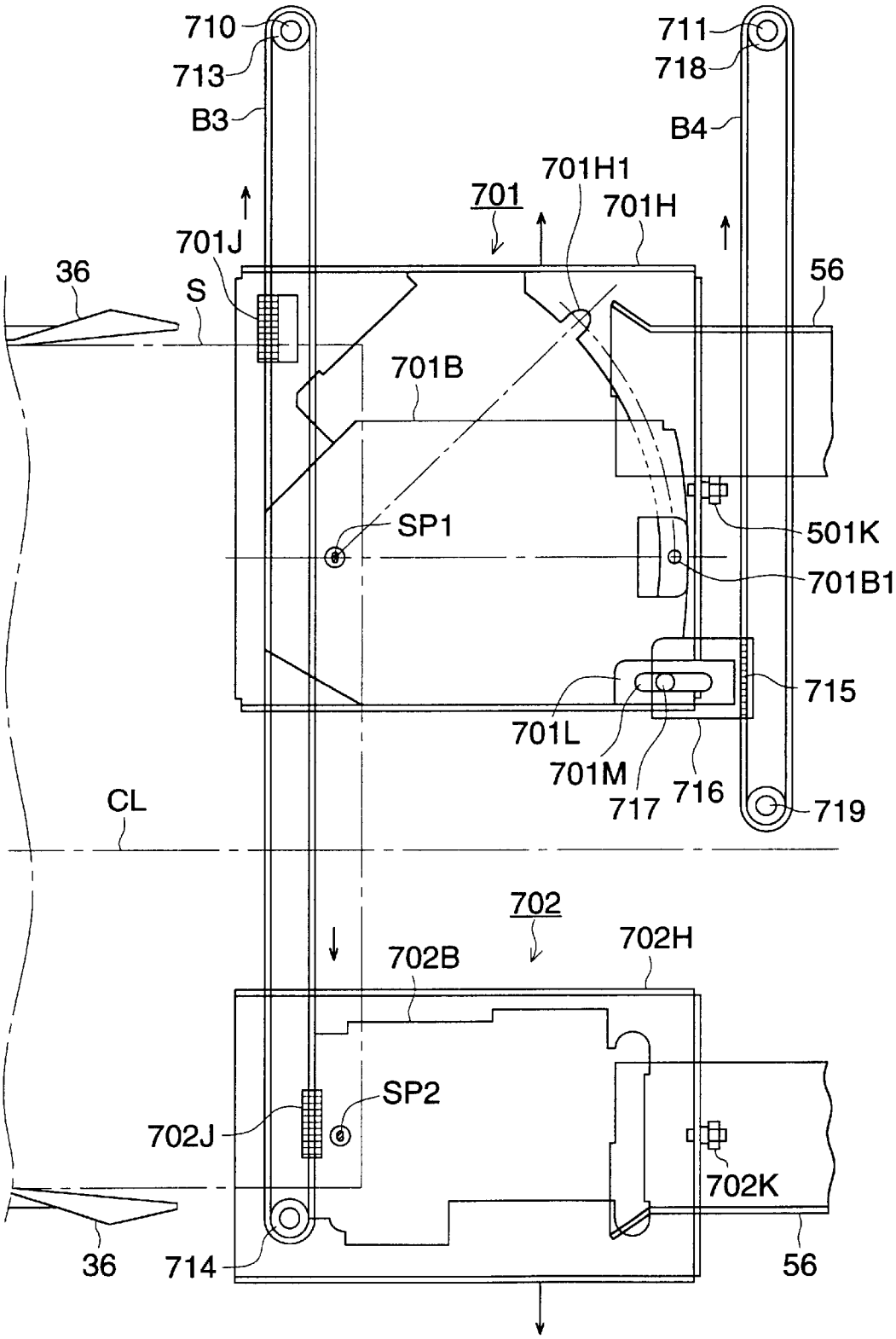
FIG. 24 is a plan view showing a driving means of each of the lower mechanisms of 2 sets of staple means.
Figure 25:
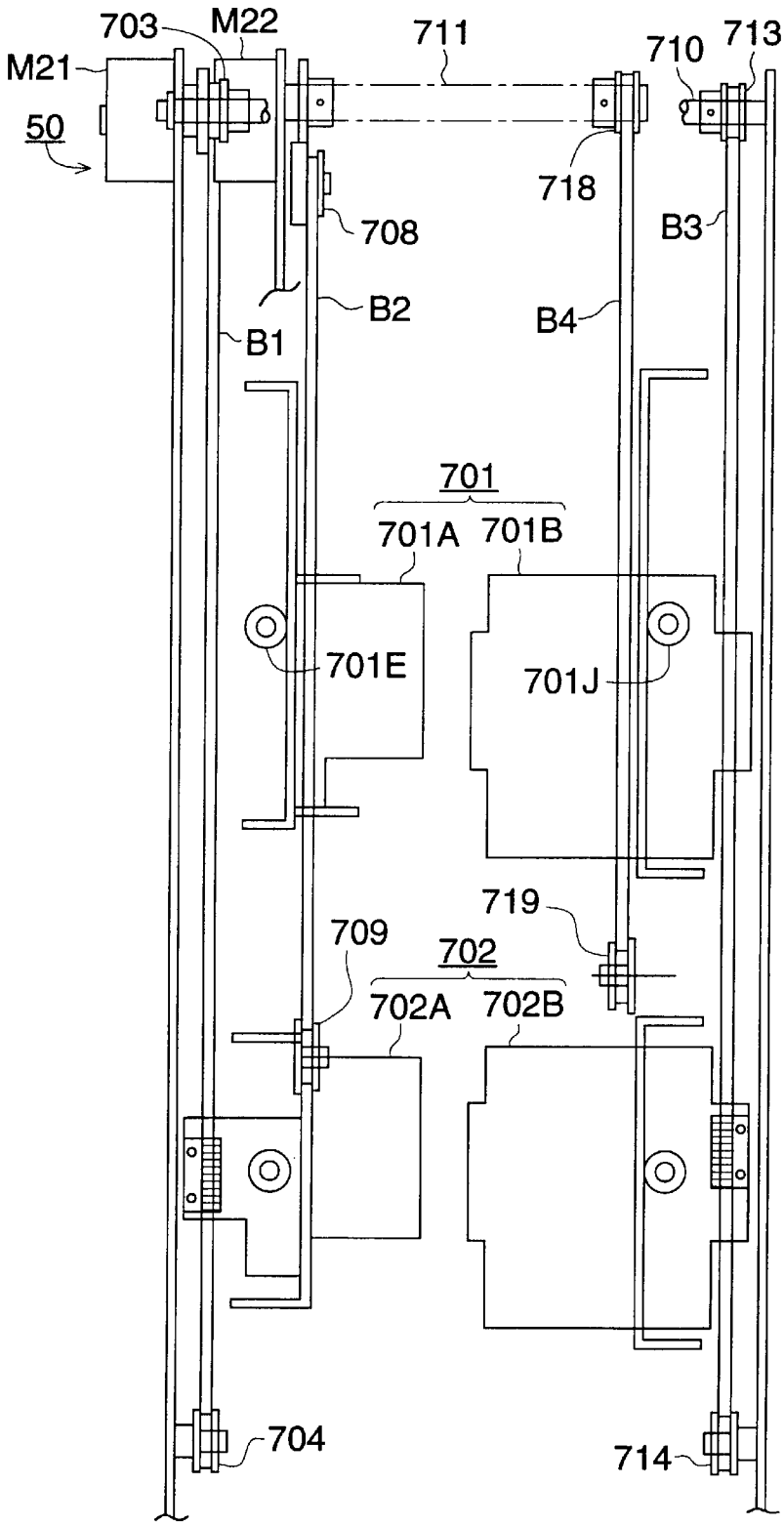
FIG. 25 is a side view showing a driving means of 2 sets of upper and lower portion separation type staple means.

FIG. 24 is a plan view showing driving means of lower mechanisms 701B and 702B of 2 sets of staple means 701 and 702. FIG. 25 is a side view showing the driving means of upward and downward separation type staple means 50 having 2 sets of staple means 701 and 702.

The lower mechanism (drive side mechanism for stapler pin putting-in) 701B of the staple means on the far side is mounted on the carriage 701H. The vicinity of leading edge portion of the carriage 701H is fixed on the rotating timing belt B3 by an engagement member 70*i*J. A rotatable roller 701E is supported in the vicinity of the trailing edge portion of the carriage 701G, and rotates on the base plate surface, not shown. The lower mechanism 701B can move in the width direction of recording sheets S (in the direction perpendicular to the recording sheet conveyance direction) together with the carriage 701H.

The lower mechanism 701B of the staple means 701 on the far side can conduct parallel stapling on the sheet end portion and slant stapling on the sheet end portion, and each stop position, it is positioned and fixed by click-stop mechanism.

That is, a lock pin 701B1 urged by a spring, is provided on the trailing edge portion of the lower mechanism 701B of the staple means 701 on the far side, and engaged in a lock hole, provided just below the lock pin, not shown, and provided on the carriage 701C, and the stationary position of the lower mechanism 701B is held. In this position, parallel stapling on the sheet end portion can be conducted together with the upper mechanism 701A.

When the lower mechanism 701A is rotated by the motor M22, the lock pin 701A1 is engaged with a lock groove 701H1 provided on the carriage 701H, and the stationary position of the lower mechanism 701B is held. At this position, the slant stapling on the sheet end portion can be conducted together with the upper mechanism 701A.

The timing belt B3 is wound around a drive pulley 713 and a driven pulley 714 and can be rotated. The drive pulley 713 to move the lower mechanism 701B and the drive pulley 703 to move the upper mechanism 701A are fixed on a fixed shaft 710, and arranged coaxially. Accordingly, when the drive pulley 703 is driven by the motor M21 and the upper mechanism 701A is moved, the drive pulley 713 is also simultaneously rotated, and the lower mechanism 701B is also moved.

A regulation plate 701L on which a long groove portion 701M is provided, is integrally formed in the vicinity of the trailing edge member of the lower mechanism 701B. A pin 717 protruded on a movement member 716 slides in the long groove portion 701M. The movement member 716 is fixed on the timing belt B4 by a engagement member 715.

The timing belt B4 is wound around a drive pulley 718 and a driven pulley 719 and can be rotated. The timing belt B4 is rotated following to the movement of the staple means 701B by the engagement of regulation member 701L fixed on the staple means 701B and a pin 717 protruded on the movement member 716.

The lower mechanism (the driven side mechanism for the staple pin clinch) 702B of the staple means 702 on this side is mounted on a carriage 702H. The vicinity of leading edge portion of the carriage 702H is fixed on the rotating timing belt B3 by an engagement member 702J. A rotatable roller 702K is supported in the vicinity of the trailing edge portion of the carriage 702H, and rotates on the base plate surface, not shown. The lower mechanism 702B can move in the width direction of recording sheets S (in the direction perpendicular to the recording sheet conveyance direction) together with the carriage 702H.

The carriage 701H on the far side and the carriage 702H on this side which are engaged with the timing belt B3, are simultaneously moved being interlocked with the movement of the upper mechanisms 701A and 701B by the drive of the motor M1, and respectively advances in the opposite direction to each other, symmetrically about the center line CL.

Figure 26:
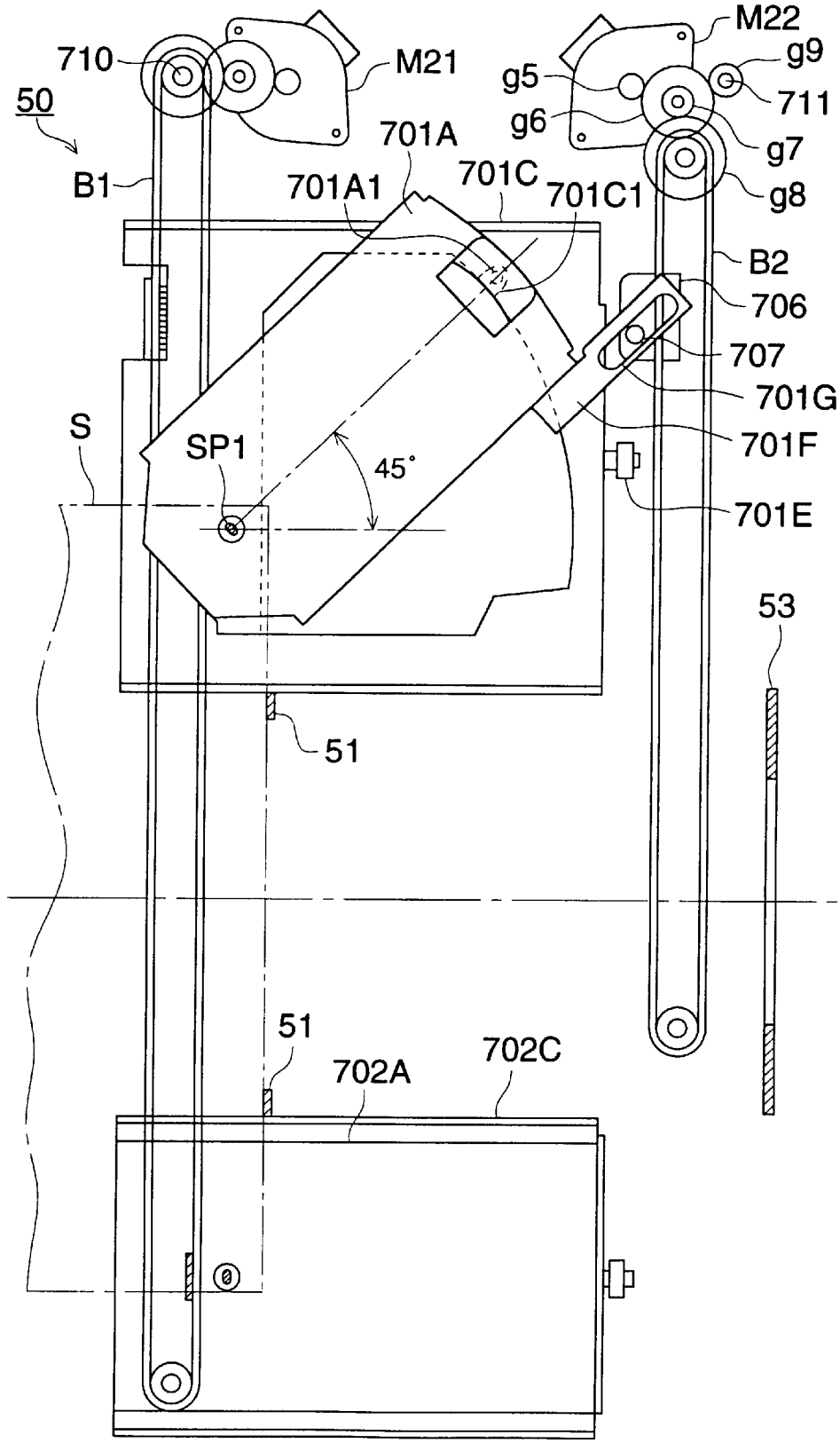
FIG. 26 is a plan view of the staple means showing a condition that the slant edge stapling processing is conducted at a corner of the sheet.

FIG. 26 is a plan view of the staple means 50 showing a condition that slant stapling processing is conducted on a corner of the sheet S.

According to the sheet size signal of the recording sheet S from the image forming apparatus A, and edge stapling setting input, the control means 90 drives the motor M21, and moves the stapler means 701, and 702 in the width direction of the sheet S, and stops at a predetermined edge stapling position.

Successively, timing belt B2 is rotated by the drive of the motor M22. A pin 707 of the movement member 706 integrated with the rotating timing belt B2 is engaged with a long groove 701G of the regulation plate 701F fixedly provided on the upper mechanism 701A of the staple means 701, and moves, and rotates the regulation plate 701F and the upper mechanism 701A.

The upper mechanism 701A is mounted on the carriage 701C, and by making the vertical center of the putting-in position of the stapler pins as the rotation center, it can be slantingly arranged to the position of rotation angle of about 45°. At this slanting position of the upper mechanism 701A, the stapler pins are put into the corner of the sheet S, and the sheet S is slantingly edge-stapled.

Being interlocked with the rotation of the upper mechanism 701A of the staple means 701, the lower mechanism 701B of the staple means 701 shown in FIG. 24 is also rotated to the position of rotation angle of about 45° around the vertical center of the putting-in position of the stapler pins SP1.

That is, by the rotation of the motor M22 shown in FIG. 23, the timing belt B2 is rotated through gears g5–g8, and the timing belt B4 wound around the drive pulley 718 provided on the lower end portion of the rotation shaft 711 of the gear g9 engaged with the gear g6, and the driven pulley 719 is rotated.

The timing belt B4 rotated being interlocked with the timing belt B2 which rotates the upper mechanism 701A of the staple means 701, rotates the lower mechanism 701B simultaneously with the upper mechanism 701A by the engagement of the movement member 716 with the regulating plate 701L.

The stop position of the rotation of the upper mechanism 701A is positioned by the engagement of the click-stop mechanism composed of the lock pin 701A1 of the upper mechanism 701A shown in FIG. 23 and the lock groove 701C1 of the carriage 701C.

The stop position of the rotation of the lower mechanism 701B is positioned by the engagement of the click-stop mechanism composed of the lock pin 701B1 of the lower mechanism 701B shown in FIG. 24 and the lock groove 701H1 of the carriage 701H.

Figure 27:
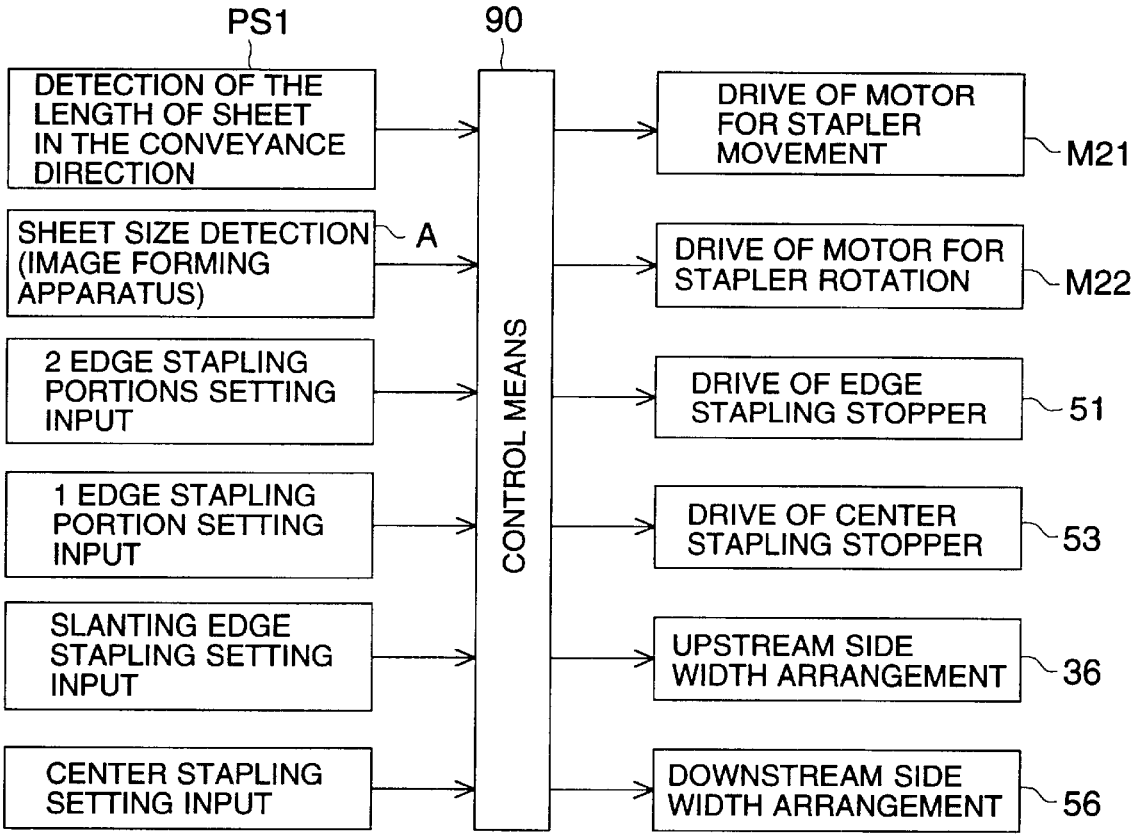
FIG. 27 is a block diagram to control the drive of the staple means.

FIG. 27 is a block diagram showing the control of the drive of the staple means 701 and 702.

The edge stapling stopper 51 and the width arrangement member 36 are driven by the sheet size (width and length of the sheet) signal from the image forming apparatus A, or the sheet length detection signal by the entry passage sensor PS1 in the sheet finisher FS, and setting input of edge stapling processing mode, and the edge stapling processing and the slant edge stapling processing are conducted by the drive of the motors M21 and M22.

Further, the center stapling stopper 53 and the width arrangement means 36 and 56 are driven by the above-described sheet size signal and the center stapling processing mode setting input, and the center stapling processing is conducted by the drive of the motor M21.

Incidentally, in the embodiment of the present invention, the sheet finisher connected to the copier is shown, however, the present invention can also be applied to the sheet finisher which is used by being connected to an image forming apparatus such as a printer, facsimile device, or similar devices.

As described above, according to the sheet finisher of the present invention, the following effects can be obtained.

The sheet finisher of the present invention is arranged such that 2 sets of staple means having the two-piece separation structure can be moved and rotated, thereby, any one of 2 portions center stapling processing, 2 portions edge stapling processing, one portion edge stapling processing, and one portion slant edge stapling processing, can be selected and conducted. Accordingly, the above-described multi-functions can be conducted by the minimum number of staple means, therefore, by the simplification of the structure, production cost can be decreased and the size of the apparatus can be reduced.

The sheet finisher of the present invention is structured such that the rotatable staple means is mounted on a carriage, and the rotation center of the staple means approximately coincides with the center of the stapler pin, thereby, when the upper mechanism and the lower mechanism of the two-pieces structure staple means are separately rotated, the phases of the upper and lower structures can be easily matched.

Stoppers are structured such that the edge stapling stopper is positioned at an operation position and a withdrawal position being interlocked with the movement of the center stapling stopper, thereby, both of stoppers can be surely driven by one drive source and a simple driving means.

Occurrence of erroneous operations or malfunctions which occurs when the center stapling stopper unit moving in the sheet conveyance direction and the edge stapling stopper which is upwardly and downwardly operated, equipped on the staple means which can move in the direction perpendicular to the conveyance direction of the sheet, are interfered with each other at the time of edge stapling processing, can be prevented.

Even when fluctuation exists in the rated length in the conveyance direction of the sheet, the position of the center stapling and the position of the edge stapling can be finely adjusted and finishing-processed.

When fluctuation exists in the rated length in the conveyance direction of the sheet, the minimum length of the sheet is measured and selected, and the position of the center stapling and the position of the edge stapling of the sheet are finely adjusted and finishing-processed, and the end portion of the two-folding processed booklet is easily cut off, thereby, the quality of the completed booklet can be increased.

When he leading edge portion of the center stapled set of sheets contacts with the movable stopper for sheet leading edge portion contact of the folding means, it is prevented that the stopper is moved by the impulse of the contact with the leading edge portion of the set of sheets and the twice-folded portion is shifted, thereby, the folding processing can be conducted in an accurate position.

By providing the downstream side width arrangement means in addition to the upstream side width arrangement means, the irregular arrangement in the width direction of the set of sheets on the sheet placement portion is solved, and when the center stapling processing and center folding processing are conducted on the set of sheets whose regularity of arrangement is increased, the quality in external appearance of the completed booklet is increased.

When the driving section of the upstream side width arrangement means and the driving section of the downstream side width arrangement means are arranged below the sheet conveyance surface, the space area above the sheet placement portion is widely opened, thereby, when the sheet conveyance failure (jam) occurs in the vicinity of the sheet placement portion, visual confirmation of the jammed sheet and its taking out becomes easy, and safety and working property are increased.

The staple means, width arrangement means, sheet end portion positioning means, and sheet placement portion are structured into a stapling portion unit, and the unit can drawn out of the sheet finisher main body, thereby, when a jam, defects of component members, staple failure, etc., occurs in the sheet finisher, or when the replenishment of the staple pins, or maintenance operation is conducted, the stapling portion unit is drawn out, thereby, operations can be easily conducted, and safety and working property are increased.

In order to convey the center stapling processed set of sheets to the next twice-folding processing process, in the case where the delivery belt and the delivery roller pair are oppositely rotated to each other, when the sheets on which edge stapling processing is not conducted, exist on the movable delivery sheet tray, a problem that an end portion of the sheet on the movable delivery sheet tray is wound into rollers by reversely rotating delivery roller pair and reversely advances into the apparatus, and the sheet damage occurs, can be solved.

In the sheet finisher by which both of the edge stapling processing and the center stapling processing can be conducted, the delivery means for delivering the edge staple processed set of sheets onto the movable delivery sheet tray outside the apparatus, is used also as the conveyance means for conveying the center stapling processed set of sheets to the next process, thereby, the structure of the sheet finisher can be made simple, and the number of components can be reduced. Further, in both processing modes of the edge stapling processing and the center stapling processing, when the initial standby position of the delivery claw is changed, the efficiency of sheet delivery and sheet conveyance can be increased, and the number of finishing processed sheets per minute is increased.

According to the present invention, desired digital processing is conducted by an image forming apparatus such a as copier, printer, facsimile device, or hybrid machine of these, and pages of delivered recording sheets are arranged in order in the sheet finisher, and processing modes such as edge stapling, center stapling, folding, etc., are conducted at the correct position.

What is claimed is:

1. An apparatus for finishing sheets having a sheet size of a plurality of different sheet sizes, comprising:

a sheet conveyor to convey a sheet in a predetermined sheet conveyance direction on a sheet conveyance path; and a stapling device to conduct an edge stapling processing to put staple pins into an edge portion of sheets, and a center stapling processing to put staple pins into a central portion of sheets; and the stapling device constructed in a divided structure including a driving mechanism provided at one side of the sheet conveyance path and a receiving mechanism provided at the other side of the sheet conveyance path, so that the divided structure is constructed to allow the sheet to pass along the sheet conveyance path between the driving mechanism and the receiving mechanism;

wherein the driving mechanism has a pin-putting section from which a staple pin is put into the sheets and the receiving mechanism has a clinching section located opposite to the pin-putting section so that the staple pin put from the pin-putting section is clinched by the clinching section;

wherein the driving mechanism and the receiving mechanism shift simultaneously in a direction perpendicular to the sheet conveyance direction between an edge stapling position to conduct the edge stapling processing and a corner stapling position to conduct the corner stapling processing, wherein a plurality of different corner stapling positions are predetermined for the plurality of different sheet sizes, and when the stapling device conducts the corner stapling processing, the driving mechanism and the receiving mechanism shift simultaneously in accordance with the sheet size of the sheet so that the pin-putting section and the clinching section locate at a corner stapling position of the plurality of different corner stapling positions, wherein the pin-putting section rotates to a predetermined angle around the axis of rotation coinciding with the center of the staple pin at the corner stapling position at the one side of the sheet conveyance path and the clinching section rotate to the same angle as the predetermined angle around the axis of rotation coinciding with the center of the staple pin at the corner stapling position at the other side of the sheet conveyance path so that the driving mechanism and the receiving mechanism staple a pin diagonally at the corner position of the sheets.

2. The apparatus for finishing sheets of claim 1, wherein the apparatus comprises a plurality of stapling devices as the stapling device, and the plurality of stapling devices are arranged in a direction perpendicular to the sheet conveyance direction and each of the plurality of stapling devices is constructed in the divided structure.

3. The apparatus for finishing sheets of claim 1 further comprising:

a shifting device having a shifting power source and two shifting mechanisms to shift the driving mechanism and the receiving mechanism simultaneously parallel to each other and a rotating device having a rotating power source and two rotating mechanisms to rotate the driving mechanism and the receiving mechanism simultaneously.

4. The apparatus for finishing sheets of claim 3 wherein each of the two shifting mechanisms comprises a belt and pulleys and the belts of the two shifting mechanisms are driven by the shifting power source and wherein each of the two rotating mechanisms comprises a belt and pulleys and the belts of the two rotating mechanisms are driven by the rotating power source.

5. The apparatus for finishing sheets of claim 3 wherein the shifting device comprises a click stop mechanism by which stop position of the driving mechanism and the receiving mechanism are determined and fixed.

6. The apparatus for, finishing sheets of claim 2 wherein the plurality of staplers are two staplers by which the edge stapling processing to put one staple pin into one edge portion of the sheets, the edge stapling processing to put two staple pins into one edge portion of the sheets or the center stapling processing to put two staple pins at two central portions of the sheets is selectively conducted.

7. The apparatus for finishing sheets of claim 2 wherein each of the plurality of staplers is rockingly rotatable.

8. The apparatus for finishing sheets of claim 1 further comprising:

a stacking device to position sand stack the sheets conveyed successively by the sheet conveyor;

a first movable stopper to move to a predetermined position in the sheet conveyance direction in accordance with the sheet size stacked on the stacking device so as to determine a position of a side of the sheets in the center stapling processing; and a second movable stopper to determine a position of an edge of the sheet in the edge stapling processing.

9. The apparatus for finishing sheets of claim 8 wherein the second movable stopper enters the sheet conveyance path so as to stop the sheets in the edge stapling processing and moves away from the sheet conveyance path so as to allow the sheets to proceed to the first movable stopper in the center stapling processing.

10. The apparatus for finishing sheets of claim 8 comprising:

a folding device having a sheet stand on which is folded;

a measuring device to measure a length of the sheets conveyed by the sheet conveyor in the sheet conveyance direction; and a third movable stopper to move in the sheet conveying direction to a predetermined position in accordance with the length of the sheets so as to determine a position of a leading end of the sheets conveyed to the sheet stand of the folding device;

wherein when the folding device produces one booklet, the positions of the first movable stopper are determined based on a minimum of the lengths measured by the measuring device.

11. The apparatus for finishing sheets of claim 9 wherein when the first movable stopper locates its home position, the second movable stopper locates at a stop position to determine the position of an edge of the sheet in the edge stapling processing.

12. The apparatus for finishing sheets of claim 11, wherein when a power source of the apparatus for finishing sheets is turned ON, an initializing operation is conducted firstly for the first movable stopper and secondly for the stop position of the staplers.

13. The apparatus for finishing sheets of claim 8, wherein the position of the first movable stopper is adjustable in accordance with a length of the sheet in terms of the sheet conveyance direction.

14. The apparatus for finishing sheets of claim 11 further comprising:

a sheet delivery tray movable upwardly or downwardly;

a sheet stand on which the sheets to be applied with the edge stapling processing or the center stapling processing are placed;

a sheet shifting device having a rotatable piece adapted to come in contact with an edge of the sheets, wherein the sheet shifting device shifts the sheets from the sheet stand toward the sheet delivery tray by rotating the rotatable piece in a first direction so as to push one side of the sheets or shifts the sheets from the sheet stand toward a next process by rotating the rotatable piece in a second direction opposite to the first direction so as to push the other side of the sheets; and a pair of rollers to receive the sheets from the sheet shifting device and to discharge the sheets to the sheet delivery tray.

15. The apparatus for finishing sheets of claim 14, wherein the sheet delivery tray is moved downwardly before the rotatable piece is rotated in the second direction.

16. The apparatus for finishing sheets of claim 14, wherein when the edge stapling processing is conducted, the rotatable piece is rotated in the first direction, and when the center stapling processing is conducted, the rotatable piece is rotated in the second direction, and wherein the rotatable piece has a first waiting position in the edge stapling processing and a second waiting position in the center stapling processing different from the first waiting position.

17. The apparatus for finishing sheets of claim 11 further comprising:

a first sheet width regulating device provided to the stapling device at an upstream side in the sheet conveyance direction and a second sheet width regulating device provided to the stapling device at a downstream side in the sheet conveyance direction so that the position of the sheet width is regulated.

18. The apparatus for finishing sheets of claim 17, wherein the first and second sheet width regulating devices conduct sheet width regulating operations in accordance with a setting in the edge stapling processing and a setting in the center stapling processing.

19. The apparatus for finishing sheets of claim 17, wherein in the edge stapling processing, the first sheet width regulating device is driven, and in the center stapling processing, the first sheet width regulating device and the second sheet width regulating device are driven.

20. The apparatus for finishing sheets of claim 19, wherein in the center stapling processing, the second sheet width regulating device is driven after the first sheet width regulating device is driven.

21. The apparatus for finishing sheets of claim 17, wherein a driving section to drive a sheet end positioning device to regulate an end of the sheet in the sheet conveyance direction is provided above the sheet conveyance path and a driving section to drive the sheet width regulating device to regulate a sheet width in a direction perpendicular to the sheet conveyance direction is provided below the sheet conveyance path.

22. The apparatus for finishing sheets of claim 18, further comprising:

a unit body in which the stapling device, the sheet width regulating device, the sheet end positioning device and the sheet stand are incorporated, wherein the unit body is constructed so as to be drawn out in a direction perpendicular to the sheet conveyance direction from a main body of the apparatus.

23. An apparatus for finishing sheets having a sheet size of a plurality of different sheet sizes, comprising:

a sheet conveyor to convey a sheet in a predetermined sheet conveyance direction on a sheet conveyance path; and a stapling device to conduct an edge stapling processing to put staple pins into an edge portion of sheets, a center stapling processing to put staple pins into a central portion of sheets, and a corner stapling processing to put a staple pin into a corner portion of sheets; and the stapling device having two staplers arranged in a direction perpendicular to a sheet conveyance direction, and each of the two staplers constructed in a divided structure including a driving mechanism provided at one side of the sheet conveyance path so as to put a staple pin into the sheets and a receiving mechanism provided at the other side of the sheet conveyance path so that the divided structure is constructed to allow the sheet to pass along the sheet conveyance path between the driving mechanism and the receiving mechanism;

wherein the stapling device conducts the edge stapling processing, the two staplers are capable of shifting in a direction perpendicular to the sheet conveyance direction and the shifting direction of one of the two staplers is reverse to the shifting direction of the other so that the two staplers shift in different directions in accordance with the sheet size of sheets, wherein when the stapling device conducts the corner stapling processing, each of the two staplers is capable of shifting in a direction perpendicular to the sheet conveyance direction to each of corner portions of sheets in accordance with the sheet size of sheets, and one of the two staplers conducts the corner stapling processing to put a staple pin into a corner portion of sheets, and each of the two staplers are able to individually rotate about a center of the staple pin, wherein the axis of rotation of each stapler coincides with an axis located at a center of a staple pin location;

wherein the driving mechanism and the receiving mechanism of each of the two staplers are structured to shift interlockingly simultaneously.

24. The apparatus for finishing sheets of claim 23 comprising:

a shifting device having a power source and a first linkage member to link two driving mechanisms and a second linkage member to link two receiving members;

wherein the power source actuates the first linkage member and the second linkage member so that the driving mechanism and the receiving mechanism of the one of the two staplers shifts interlockingly simultaneously in the direction perpendicular to the sheet conveyance direction, and the driving mechanism and the receiving mechanisms of the other one of the two staplers shift interlockingly simultaneously in the direction opposite to the shifting direction of the one of the two staplers.

25. The apparatus for finishing sheets of claim 24 wherein the shifting device comprises a click stop mechanism by which stop positions of the driving mechanism and the receiving mechanism are determined and fixed.

26. The apparatus for finishing sheets of claim 23 comprising:

a stacking device to position and stack the sheets conveyed successively by the sheet conveyor;

a first movable stopper to move to a predetermined position in the sheet conveyance direction in accordance with the sheet size stacked on the stacking device so as to determine a position of a side of the sheets in the center stapling processing; and a second movable stopper to determine a position of an edge of the sheet in the edge stapling processing.

27. The apparatus for finishing sheets of claim 24 wherein a second movable stopper enters into the sheet conveyance path so as to stop the sheets in the edge stapling processing and moves away from the sheet conveyance path so as to allow the sheets to proceed to the first movable stopper in the center stapling processing.

28. The apparatus for finishing sheets of claim 10 further comprising:

a stepping motor driving device to move the third movable stopper;

a detector to detect the passage of the sheets toward the third movable stopper and to output a detection signal; and a controller to control the stepping motor driving device in response to the detection signal from the detector so as to stop the rotation of the stepping motor driving device immediately before the leading end of the sheets comes in contact with the third stopper.

29. The apparatus for finishing sheets of claim 28, wherein the controller allows the stepping motor driving device to rotate after the folding device starts a folding operation.

* * * * *